US011721500B2

(12) United States Patent
Chang et al.

(10) Patent No.: US 11,721,500 B2
(45) Date of Patent: Aug. 8, 2023

(54) KEYSWITCH ASSEMBLY AND SUPPORT MECHANISM THEREOF

(71) Applicant: Darfon Electronics Corp., Taoyuan (TW)

(72) Inventors: Li-Te Chang, Taoyuan (TW); Chih-Hung Chen, Taoyuan (TW); Yen-Ting Chen, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 17/715,120

(22) Filed: Apr. 7, 2022

(65) Prior Publication Data

US 2022/0328265 A1 Oct. 13, 2022

Related U.S. Application Data

(60) Provisional application No. 63/171,633, filed on Apr. 7, 2021, provisional application No. 63/233,348, filed (Continued)

(30) Foreign Application Priority Data

Oct. 14, 2021 (TW) ..... 110138221

(51) Int. Cl.
*H01H 13/14* (2006.01)
*H01H 13/20* (2006.01)

(52) U.S. Cl.
CPC ..... *H01H 13/14* (2013.01); *H01H 13/20* (2013.01)

(58) Field of Classification Search
CPC ..... H01H 2215/006; H01H 2219/014; H01H 2219/036; H01H 2219/048; (Continued)

(56) References Cited

U.S. PATENT DOCUMENTS 4,479,111 A 10/1984 Madsen et al.
4,836,636 A 6/1989 Obara et al.
(Continued)

FOREIGN PATENT DOCUMENTS

CN 101834081 B 9/2012
CN 203521244 U 4/2014
(Continued)

OTHER PUBLICATIONS

Non-Final Office Action dated Mar. 30, 2023, issued in U.S. Appl. No. 17/715,143.

*Primary Examiner* — Anthony R Jimenez
(74) *Attorney, Agent, or Firm* — McClure, Qualey & Rodack, LLP

(57) ABSTRACT

A keyswitch assembly includes a switch module, a support mechanism, and a blocking mechanism. The switch module includes a substrate, a signal generator, and a signal sensor. The signal generator provides a sensing signal. The signal sensor receives the sensing signal to obtain a sensing intensity. The support mechanism is disposed on the substrate. A top portion of the support mechanism moves in response to a pressing force. The blocking mechanism includes a pivoting portion rotatably disposed on the substrate, a connecting piece extending from the pivoting portion and movably connected to the support mechanism to be driven by the top portion to swivel relative to the substrate, and a blocking piece extending from the pivoting portion and driven by the connecting piece to be inserted into or escape from the gap between the signal generator and the signal sensor to change the magnitude of the sensing intensity.

19 Claims, 21 Drawing Sheets

Related U.S. Application Data on Aug. 16, 2021, provisional application No. 63/255,450, filed on Oct. 14, 2021.

(58) Field of Classification Search

CPC ..... H01H 2219/054; H01H 2219/064; H01H 2221/00; H01H 2221/024; H01H 2221/03; H01H 2221/064; H01H 2221/08; H01H 2239/022; H01H 2003/12; H01H 2003/32; H01H 2009/02; H01H 2013/00; H01H 2013/02; H01H 2013/50; H01H 2013/52; H01H 2013/525; H01H 2013/56; H01H 2203/05; H01H 13/00; H01H 13/02; H01H 13/10; H01H 13/12; H01H 13/14; H01H 13/20; H01H 13/50; H01H 13/52; H01H 13/70; H01H 13/7006; H01H 13/78; H01H 13/803; H01H 13/83; H01H 3/00; H01H 3/02; H01H 3/12

USPC ..... 200/345

See application file for complete search history.

(56) References Cited

U.S. PATENT DOCUMENTS

| | | | | |
|---|---|---|---|---|
| 5,266,949 | A | 11/1993 | Rossi | |
| 5,813,521 | A | 9/1998 | Koike et al. | |
| 6,867,680 | B1 | 3/2005 | Kulle | |
| 7,138,587 | B2 | 11/2006 | Nishino et al. | |
| 8,299,382 | B2 | 10/2012 | Takemae et al. | |
| 9,099,261 | B2 | 8/2015 | Hsu et al. | |
| 9,236,205 | B2 | 1/2016 | Hsu et al. | |
| 9,634,661 | B1 | 4/2017 | Chen | |
| 9,838,006 | B2 | 12/2017 | Chen | |
| 9,952,682 | B2 | 4/2018 | Zhang et al. | |
| 10,637,470 | B2 | 4/2020 | Wang et al. | |
| 11,018,667 | B2 | 5/2021 | Yang et al. | |
| 11,108,393 | B2 | 8/2021 | Yang et al. | |
| 11,223,357 | B2 | 1/2022 | Hsieh et al. | |
| 11,257,635 | B2 * | 2/2022 | Ruff | H01H 3/125 |
| 2016/0179212 | A1 | 6/2016 | Toraille et al. | |
| 2017/0019102 | A1 | 1/2017 | Chen | |
| 2017/0090104 | A1 | 3/2017 | Cao et al. | |
| 2017/0115747 | A1 | 4/2017 | Chen et al. | |
| 2017/0178830 | A1 | 6/2017 | Feng | |
| 2017/0264294 | A1 | 9/2017 | Li | |
| 2018/0008619 | A1 | 1/2018 | Baheti et al. | |
| 2020/0294733 | A1 | 9/2020 | Ruff | |
| 2020/0411257 | A1 | 12/2020 | Chang et al. | |
| 2021/0351773 | A1 | 11/2021 | Yang et al. | |
| 2022/0044886 | A1 | 2/2022 | Han | |
| 2022/0328265 | A1 | 10/2022 | Chang et al. | |
| 2022/0385288 | A1 | 12/2022 | Yang et al. | |

FOREIGN PATENT DOCUMENTS

| | | | |
|---|---|---|---|
| CN | 203812764 | U | 9/2014 |
| CN | 204130394 | U | 1/2015 |
| CN | 204407228 | U | 6/2015 |
| CN | 204441139 | U | 7/2015 |
| CN | 204442328 | U | 7/2015 |
| CN | 104991319 | A | 10/2015 |
| CN | 104992867 | A | 10/2015 |
| CN | 105006396 | A | 10/2015 |
| CN | 105097342 | A | 11/2015 |
| CN | 205004229 | U | 1/2016 |
| CN | 205004233 | U | 1/2016 |
| CN | 105429620 | A | 3/2016 |
| CN | 205092842 | U | 3/2016 |
| CN | 104299818 | B | 9/2016 |
| CN | 105931907 | A | 9/2016 |
| CN | 104362019 | B | 1/2017 |
| CN | 206180999 | U | 5/2017 |
| CN | 107017870 | A | 8/2017 |
| CN | 105118723 | B | 11/2017 |
| CN | 206758332 | U | 12/2017 |
| CN | 208226984 | U | 12/2018 |
| CN | 106887358 | B | 3/2020 |
| CN | 111180233 | A | 5/2020 |
| CN | 111725015 | A | 9/2020 |
| CN | 112133583 | A | 12/2020 |
| CN | 110199369 | B | 7/2021 |
| TW | 201705171 | A | 2/2017 |
| TW | 201735079 | A | 10/2017 |
| TW | 201931405 | A | 8/2019 |
| TW | 201931408 | A | 8/2019 |
| TW | M603617 | U | 11/2020 |
| TW | 202103197 | A | 1/2021 |

* cited by examiner

KEYSWITCH ASSEMBLY AND SUPPORT MECHANISM THEREOF

BACKGROUND OF THE INVENTION

1. Field of the Invention

The invention generally relates to a keyswitch. Particularly, the invention relates to a keyswitch assembly and a support mechanism thereof.

2. Description of the Prior Art

Membrane keyswitches and mechanical keyswitches are common types of keyswitch for keyboards. The major difference between the membrane keyswitch and the mechanical keyswitch is the circuit structure for generating the triggering signal. In general, the membrane keyswitch utilizes the membrane circuit as a switch for generating the triggering signal. When the keycap is pressed to trigger the membrane circuit, the upper circuit layer is deformed to enable the upper switch contact of the upper circuit layer to contact the corresponding lower switch contact of the lower circuit layer, so the membrane circuit is conducted to generate the signal. However, the membrane circuit is easily damaged and difficult to be repaired when it is frequently used or operated by improper forces. Moreover, when the user presses the keycap to trigger the membrane circuit, the tactile feedback is less significant, which causes the pressing feeling to be poor and cannot satisfy the user's expectation.

The mechanical keyswitch is triggered based on whether the metal piece and the metal contact are conducted. However, the metal piece and the metal contact are easily worn out due to operation impact, which reduces the life of the keyswitch. The metal piece and the metal contact are also prone to rusty, resulting in poor conduction, which affects the operation stability of the keyswitch. Moreover, conventional mechanical keyswitches are more complicated in structure and bigger in volume and not suitable for portable electronic devices having higher thinning requirements, such as laptop computers.

SUMMARY OF THE INVENTION

It is an object of the invention to provide a keyswitch assembly, which provides a fast and accurate triggering function based on the receiving status of the sensing signal changed by the component of the keyswitch assembly, which is movable during the stroke.

It is another object of the invention to provide a support mechanism for keyswitch, which can balance the pressing force received by the keycap to uniformly transfer the pressing force to the support mechanism, so as to achieve an accurate triggering function.

In an embodiment, the invention provides a keyswitch assembly including a switch module, a support mechanism, and a blocking mechanism. The switch module includes a substrate, a signal generator, and a signal sensor. The signal generator and the signal sensor are disposed on the substrate. The signal generator is configured to provide a sensing signal to the signal sensor, and the signal sensor is configured to receive the sensing signal to correspondingly obtain a sensing intensity. The support mechanism is disposed on a top surface of the substrate, and a top portion of the support mechanism moving along an up-down direction in response to a pressing force. The blocking mechanism includes a pivoting portion, a connecting piece, and a blocking piece.

The pivoting portion is rotatably disposed on the top surface. The connecting piece extends from the pivoting portion. The connecting piece is movably connected to the support mechanism to be driven by movement of the top portion, so as to swivel along the up-down direction relative to the substrate. The blocking piece extends from the pivoting portion. The blocking piece is configured to be driven by the connecting piece to be inserted into or escape from a gap between the signal generator and the signal sensor, so as to change a magnitude of the sensing intensity.

In another embodiment, the invention provides a support mechanism for a keyswitch including a substrate. The support mechanism includes two frames. The substrate has a top surface. Each of the frames has a baseplate end and a keycap end, and each of the baseplate ends is movably connected to the substrate. The two frames extend outward, so that the keycap ends of the two frames are away from each other. Each of the frames further has a frame body and a side arm. The side arm extends from the frame body. Each of the frame bodies constitutes the keycap end, and a distal end of each of the side arms constitutes the baseplate end.

A front end of each of the side arms is provided with a pressing piece and a receiving piece. The pressing piece and the receiving piece extend outward along a longitudinal direction of the corresponding side arm. For each of the frames, the pressing piece of one of the two frames is positioned over the receiving piece of the other one of the two frames.

Compared to the prior art, the keyswitch assembly of the invention utilizes the support mechanism to drive the blocking mechanism to change the degree of blocking the sensing signal as a switch signal, so as to achieve fast and accurate conversion of the pressing signal, and can be applied to various kinds of keyswitch structures for portable electronic devices. Moreover, the two frames of the support mechanism of the invention are linked with each other through the linkage mechanism, so that the two frames and the keycap can be linked together, and the movement of the blocking mechanism can be linked with the movement of the keycap, effectively preventing that the pressed status of the keycap cannot be detected correctly.

DETAILED DESCRIPTION OF THE PREFERRED EMBODIMENT

Figure 1:
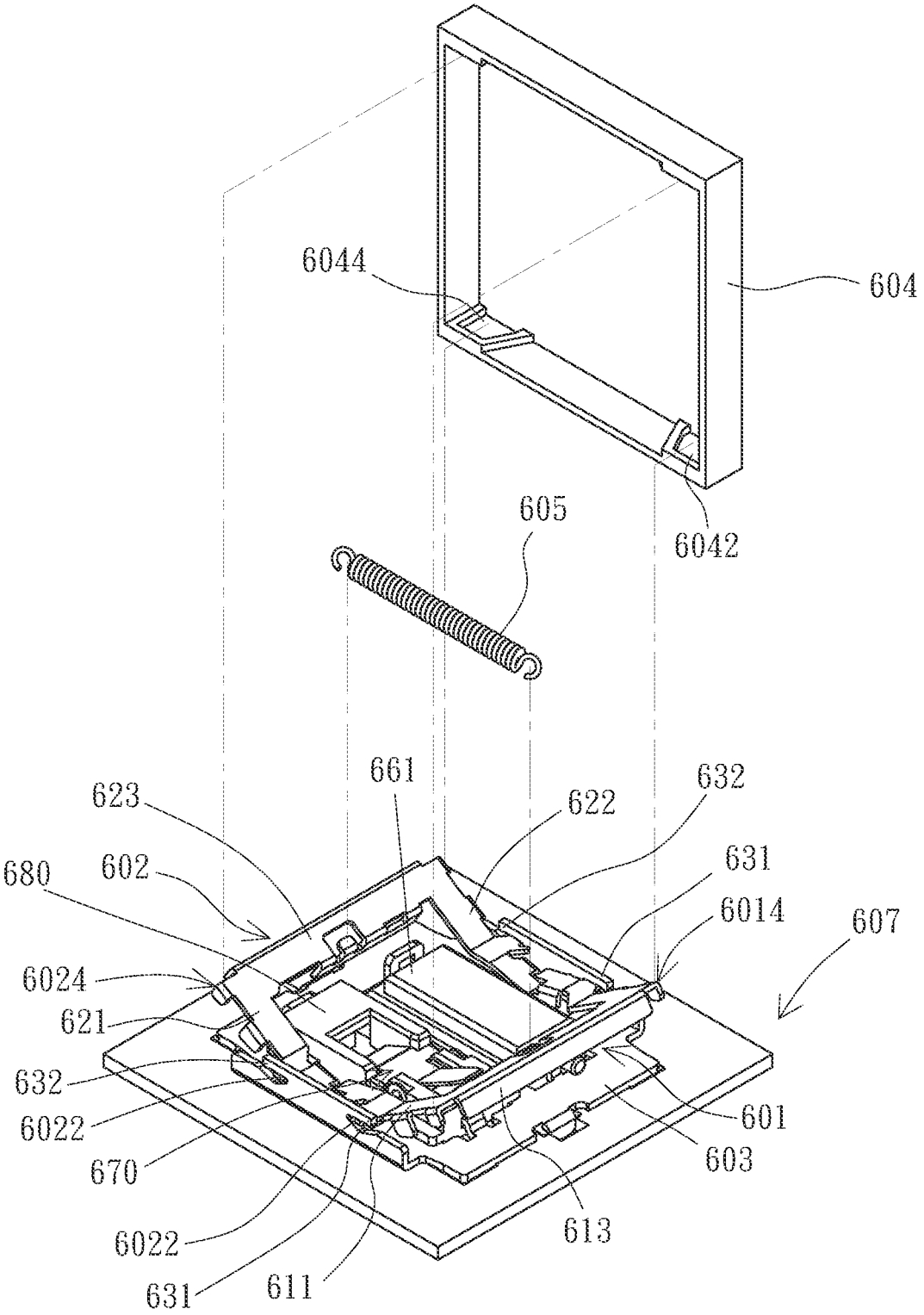
FIG. 1 is a partially exploded view of the keyswitch assembly in a first embodiment of the invention.
Figure 2:
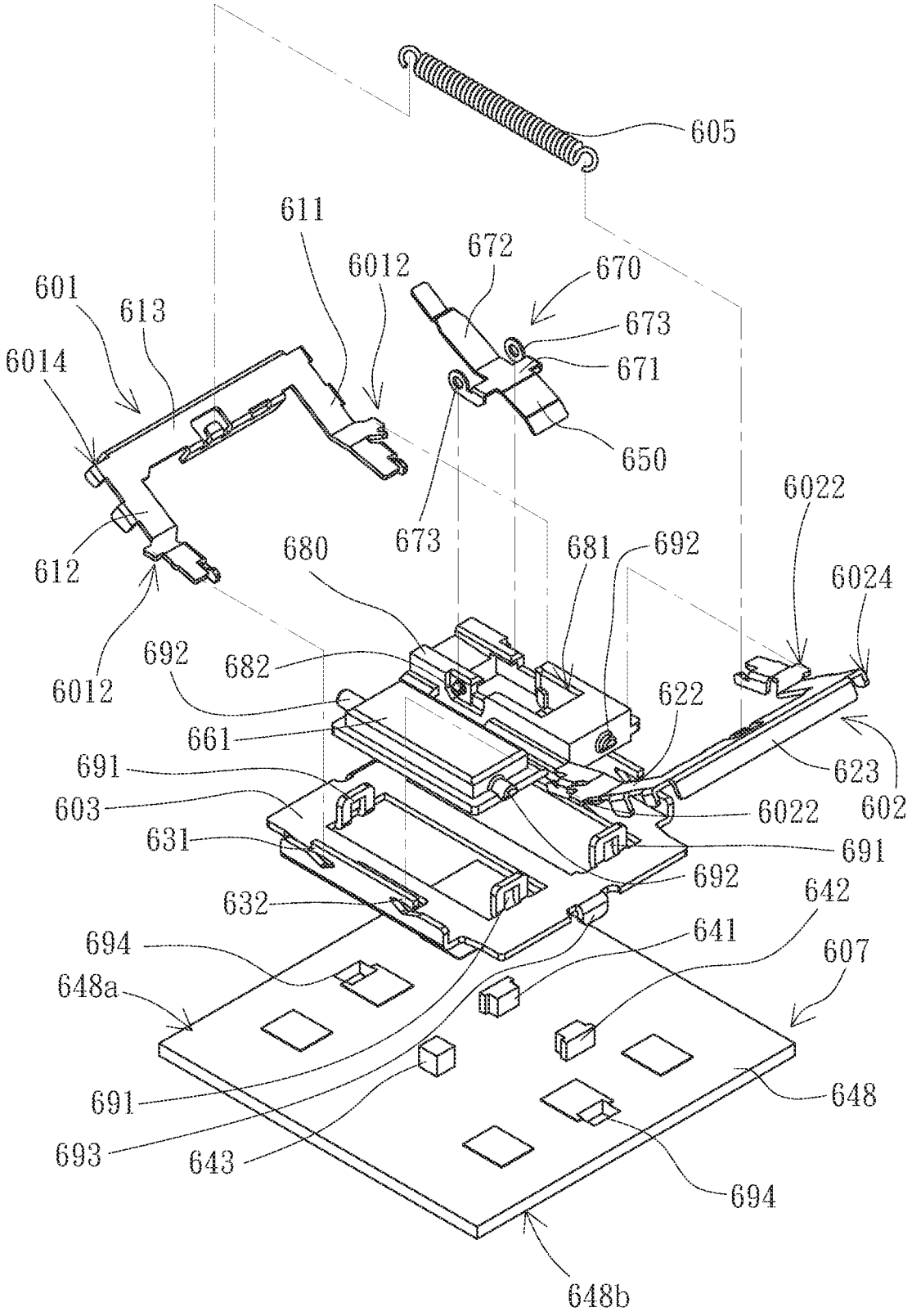
FIG. 2 is a partially exploded view of some components in the first embodiment of the invention.

Referring to FIG. 1 and FIG. 2, the invention provides a keyswitch assembly, which can be applied to any pressing-type input device (e.g. keyboard) or integrated to any suitable electronic devices (e.g. keybuttons or keyboard equipped in portable devices or lap top computers), so as to provide fast and accurate triggering function. The keyswitch assembly is applicable to various keyswitch designs, and the repairability is promoted. Hereinafter, the structure and operation of the keyswitch assembly of the invention will be described in detail with reference to the drawings.

Referring to FIG. 1 and FIG. 2, the keyswitch assembly includes a switch module 607, a keycap 604, a support mechanism, a resilient member 605, a blocking mechanism 670, and a backlight source 643.

As shown in FIG. 1, FIG. 2, FIG. 3, and FIG. 4, the switch module 607 has a substrate 648 and a pair of a signal generator and a signal sensor. The signal generator and the signal sensor are disposed on the substrate 648. The signal generator is configured to provide a sensing signal to the signal sensor, and the signal sensor is configured to receive the sensing signal to correspondingly obtain a sensing intensity. In the example provided below, the signal generator is a light emitter 641, the signal sensor is a light receiver 642, and the sensing signal is an optical signal, thereby constituting a switch, but the invention does not exclude the use of magnetic switch. In the following descriptions, the relative positions of the signal generator (light emitter 641) and the signal sensor (light receiver 642) can be interchanged. The invention is not limited to a straight optical path, and the optical switch function can also be realized through a tortuous optical path of refraction and/or reflection.

Figure 3:
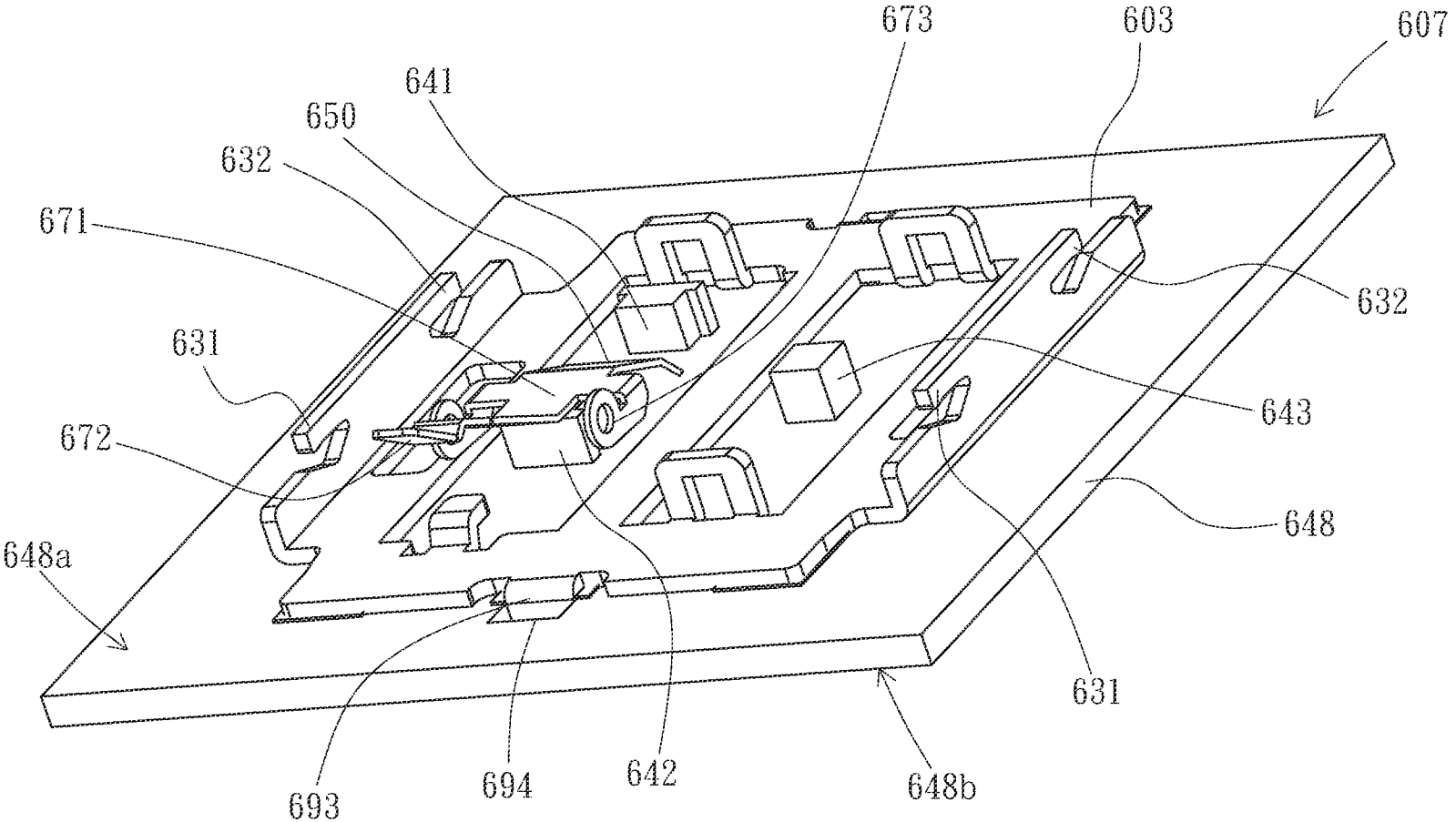
FIG. 3 is a three-dimensional view of the switch module, the blocking mechanism, and the backlight source in the first embodiment of the invention.
Figure 4:
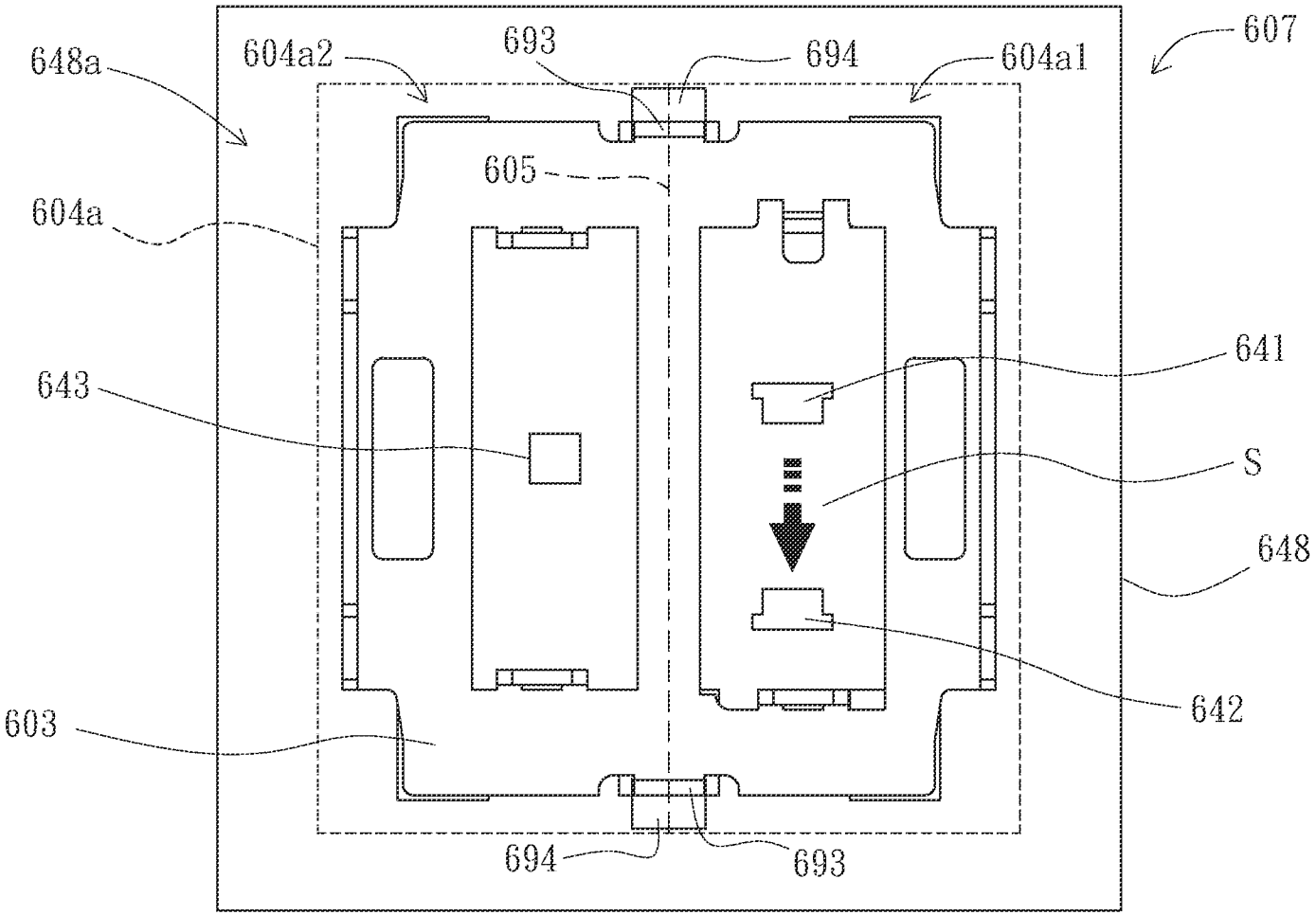
FIG. 4 is a top view of the switch module and the backlight source in the first embodiment of the invention.

As shown in FIG. 2, FIG. 3, and FIG. 4, the substrate 648 has a top surface 648*a* and a bottom surface 648*b*. The light emitter 641 and the light receiver 642 are disposed on the top surface 648*a* of the substrate 648. A fixed gap is maintained between the light emitter 641 and the light receiver 642. The light emitter 641 and the light receiver 642 are coupled to a processor (not shown) through the substrate 648, so as to constitute a switch that can generate trigger events. In an embodiment, the substrate 648 is a circuit board. The light emitter 641 and the light receiver 642 are electrically connected to the circuit board and further connected to the processor. In a different embodiment, the substrate 648 is a board-like member without signal-transmitting function. In such a case, the light emitter 641 and the light receiver 642 are electrically connected to a flexible circuit board, and the flexible circuit board is positioned on the top surface 648*a*, so that the light emitter 641 and the light receiver 642 are indirectly disposed on the top surface 648*a*.

Referring again to FIG. 3 and FIG. 4, in a first embodiment, the sensing signal S is light of specific wavelength, especially infrared light. The light emitter 641 projects light of specific wavelength as the sensing signal to the light receiver 642, and the light receiver 642 receives the light of specific wavelength to corresponding obtain the sensing intensity. In general, the light receiver 642 receives the light to generate a corresponding voltage signal, so the sensing intensity can be the voltage value of the voltage signal generated by the light receiver 642 after receiving the light of specific wavelength.

In a different embodiment, the signal generator and the signal sensor can be a magnet and a Hall sensor, respectively. The magnet is configured to create a magnetic field as the sensing signal, and the Hall sensor is configured to sense the exist and magnitude of the magnetic field through Hall effect, so as to obtain the sensing intensity. The output voltage of the Hall sensor is proportional to the magnitude of the magnetic field, so the sensing intensity can be the voltage value of the voltage signal output by the Hall sensor after sensing the magnetic field.

As shown in FIG. 1 and FIG. 4, the keycap 604 is positioned over the top surface 648*a* through support of the support mechanism, and the keycap 604 is provided with a light-exit region (not shown). The light-exit region can be a hollow region, and the hollow region can be filled with or without light-permeable materials. Alternatively, the keycap 604 can be made of light-permeable material and coated with an opaque coating to leave the light-exit region uncoated. The support mechanism, the blocking mechanism, and the backlight source 643 are substantially located within the projection 604*a* of the keycap 604 on the substrate 648, and the location of the backlight source 643 corresponds to the light-exit region. The support mechanism can move in response to the pressing force. Particularly, a top portion of the support mechanism can move along an up-down direction in response to the pressing force. The keycap 604 is disposed on the top portion of the support mechanism, and the upper surface of the keycap 604 is configured to receive the pressing force externally exerted thereto. The keycap 604 transfers the pressing force to the top portion of the support mechanism, so the top portion of the support mechanism moves in response to the pressing force to support the keycap 604 to move relative to the substrate 648 along the up-down direction.

As shown in FIG. 1 and FIG. 2, specifically, the support mechanism includes two frames, such as a first frame 601 and a second frame 602. Each of the first frame 601 and the second frame 602 has a baseplate end (e.g. baseplate end 6012 and baseplate end 6022) and a keycap end (e.g. keycap end 6014 and keycap end 6024). The baseplate ends 6012 and 6022 can be movably connected to the top surface 648*a* of the substrate 648. The keycap ends 6014 and 6024 can constitute the top portion of the support mechanism. The first frame 601 and the second frame 602 extend outward, so that the two keycap ends 6014 and 6024 are away from each other. The keycap ends 6014 and 6024 of the first frame 601 and the second frame 602 are movably connected to the keycap 604, so the keycap 604 is supported on the top portion of the support mechanism to be able to transfer the pressing force to the two keycap ends 6014 and 6024. On the top surface 648*a* of the substrate 648, the light emitter 641 and the light receiver 642 are located between projections of the two keycap ends 6014 and 6024 on the top surface 648*a*.

As shown in FIG. 1 and FIG. 2, the resilient member 605 can be a tension spring or any elements that provide tension, such as a wire made of elastic material. The resilient member 605 is traversely connected to the support mechanism. For example, the resilient member 605 is connected to the two keycap ends 6014 and 6024 and provides a pulling force between the two keycap ends 6014 and 6024, and such a pulling force enables the two keycap ends 6014 and 6024 to approach each other and move upward. In other words, the pulling force enables the first frame 601 and the second frame 602 to swivel upward, and the top portion of the support mechanism moves upward. Specifically, in this embodiment, the invention does not exclude that the two ends of the resilient member 605 are respectively connected to other portions of the first frame 601 and the second frame 602, as long as the connection of the resilient member 605 can enable the first frame 601 and the second frame 602 to swivel upward to drive the two keycap ends 6014 and 6024 to approach each other and move upward. As such, the top portion of the support mechanism moves upward, and a restoring force capable of pushing the keycap 604 upward is provided.

As shown in FIG. 1 and FIG. 2, specifically, each of the first frame 601 and the second frame 602 includes a frame body (e.g. frame body 613 and frame body 623) and two side arms (e.g. two side arms 611, 612 and two side arms 621 and 622). In the first frame 601 and the second frame 602, the two side arms 611 and 612 and the two side arms 621 and 622 respectively extend from two ends of the frame bodies 613 and 623 and are movably connected to the top surface 648*a* of the substrate 648. The frame bodies 613 and 623 are perpendicular to the connection direction of the resilient member 605, and the resilient member 605 is connected between the two frame bodies 613 and 623 to normally provide the pulling force to the two frame bodies 613 and 623, so the two frame bodies 613 and 623 approach each other, and the restoring force that pushes the keycap 604 upward is provided. The frame bodies 613 and 623 constitute the keycap ends 6014 and 6024 of the first frame 601 and the second frame 602, respectively. The distal ends of the two side arms 611 and 612 and the two side arms 621 and 622 constitute the baseplate ends 6012 and 6022 of the first frame 601 and the second frame 602, respectively.

As shown in FIG. 2, FIG. 3, FIG. 4, and FIG. 5, the support mechanism further includes a baseplate 603. The baseplate 603 is combined with the top surface 648*a* of the substrate 648. The baseplate 603 has connecting members 631 and 632. The connecting members 631 and 632 can be hook-like portions disposed on two ends of a plate, and the plate is integrally formed with the baseplate 603 and extends toward a direction away from the substrate 648. The plates can be disposed in pair parallel to each other, so each pair of corresponding hooks-like portions constitutes one of the connecting members 631 and 632. Each of the baseplate ends 6012 and 6022 can be movably coupled with the connecting members 631 and 632, thereby being movably connected to the baseplate 603. Meanwhile, the keycap ends 6014 and 6024 can be movably coupled with the keycap 604. As such, a butterfly-type support mechanism is formed to stably support the keycap 604 to move relative to the substrate 648 along the up-down direction. In the case that no baseplate 603 is provided, the connecting members 631 and 632 can be directly fixed on the top surface 648*a* of the substrate 648. As such, the baseplate ends 6012 and 6022 of the first frame 601 and the second frame 602 can be movably connected to the connecting members 631 and 632 on the top surface 648*a*. In another embodiment, the baseplate 603 can be omitted, and the baseplate ends 6012 and 6022 are directly coupled to the circuit board 644. Moreover, in other embodiments, the first frame 601 and the second frame 602 can be pivotally connected to each other to form a scissor-like support mechanism.

As shown in FIG. 1, specifically, the keycap 604 can be, for example, an injection-molded rectangular keycap, and the keycap 604 has coupling members 6042 and 6044 formed on its bottom surface to couple the support mechanism. In an embodiment, the coupling members 6042 and 6044 can be a coupling structure with a pivotal hole and a coupling structure with a groove, respectively. Alternatively, both the coupling members 6042 and 6044 can be coupling structures with grooves. The keycap ends 6014 and 6024 of the first frame 601 and the second frame 602 can be respectively movably connected to the coupling members 6042 and 6044, and at least one of the keycap ends 6014 and 6024 can be slidable relative to a corresponding one of the coupling members 6042 and 6044. As such, the keycap ends 6014 and 6024 can be movably connected to the keycap 604, and the keycap 604 can transfer the pressing force to the keycap ends 6014 and 6024.

Figure 6:
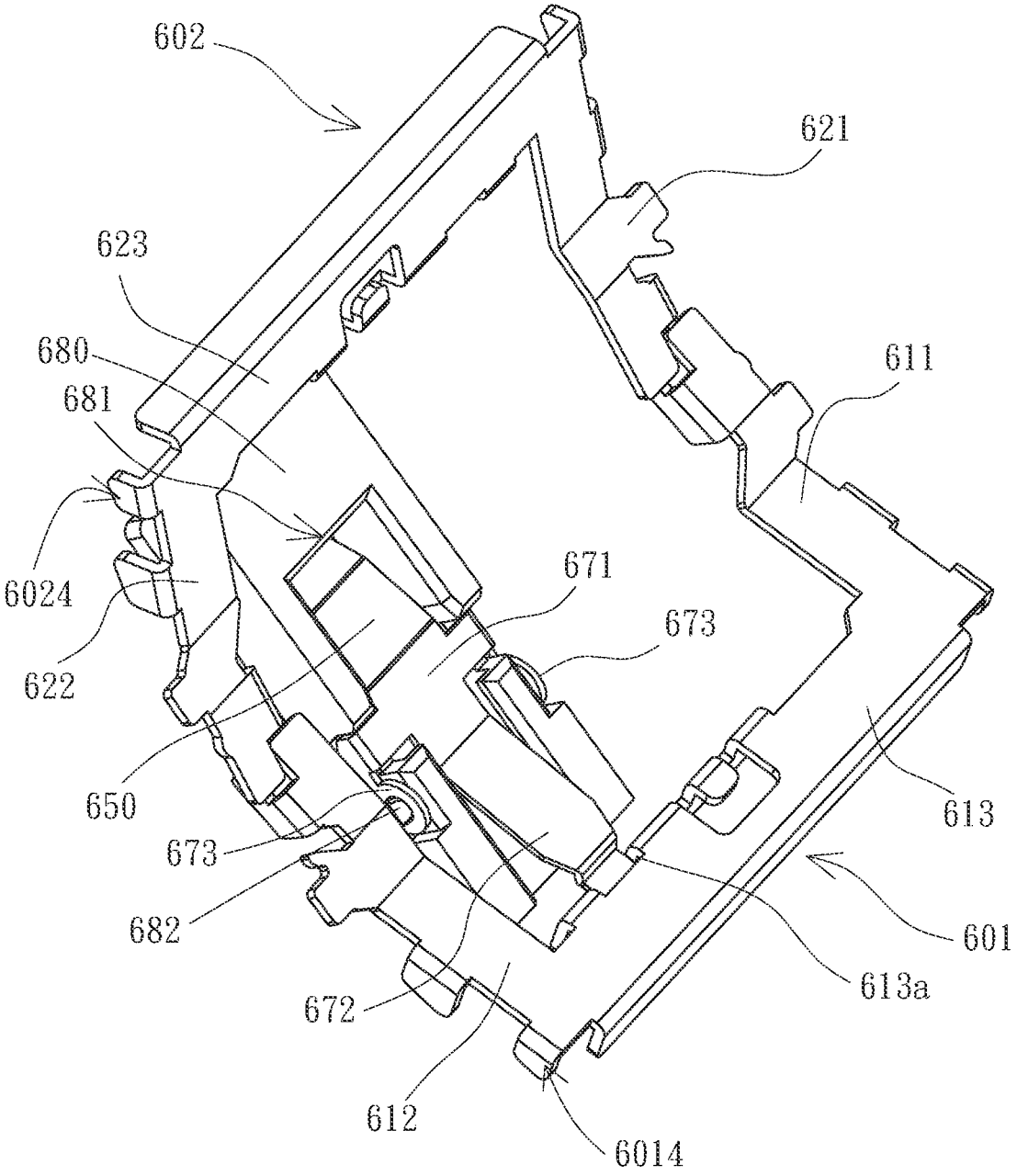
FIG. 6 is a three-dimensional view of two frames, the blocking mechanism, and the shielding member in the first embodiment of the invention.

As shown in FIG. 2, FIG. 3, and FIG. 6, the blocking mechanism 670 includes a pivoting portion 671, a connecting piece 672, and a blocking piece 650. The pivoting portion 671 is rotatably disposed on the top surface 648*a* of the substrate 648. The rotation axis of the pivoting portion 671, the rotation axis of the first frame 601, and the rotation axis of the second frame 602 are substantially parallel.

As shown in FIG. 2, FIG. 3, and FIG. 6, the connecting piece 672 extends from the pivoting portion 671. The connecting piece 672 can be directly or indirectly movably connected to the support mechanism to be driven by movement of the top portion and the keycap 604, so as to swivel along the up-down direction relative to the substrate 648. The blocking piece 650 extends from the pivoting portion 671. The blocking piece 650 is configured to be driven by the connecting piece 672 to be inserted into or escape from the gap between the light emitter 641 and the light receiver 642, so as to change the magnitude of the sensing intensity.

Specifically, when the signal generator and the signal sensor are the combination of the light emitter 641 and the light receiver 642, the blocking mechanism 670 is made of opaque material, especially made of a material capable of blocking the light of specific wavelength. Alternatively, the surface of the blocking mechanism 670 can be coated with an opaque material, so the entire blocking mechanism 670 is opaque to light.

When the signal generator and the signal sensor are the combination of the magnet and the Hall sensor, at least the blocking piece 650 is doped with a magnetically conductive material (e.g. iron, cobalt, nickel, or alloys thereof). Alternatively, the blocking piece 650 can be made of magnetically conductive iron, cobalt, nickel, or its alloy. In another embodiment, the entire blocking mechanism 670 can be made of magnetically conductive material. For example, the blocking mechanism 670 can be formed by directly stamping iron, cobalt, nickel, or their alloy sheet.

As shown in FIG. 6, in the first embodiment, the connecting piece 672 is movably connected to one of the keycap ends 6014 and 6024 of the first frame 601 and the second frame 602. For example, the connecting piece 672 is shown to be movably connected to the keycap end 6014 of the first frame 601. It is noted that first/second is only used to distinguish different elements, and it does not necessarily mean that the structures of the elements are different. The first frame 601 and the second frame 602 can be identical elements. Therefore, the connection of the connecting piece 672 to the keycap end 6014 of the first frame 601 or the keycap end 6024 of the second frame 602 does not substantially change the connection relationship.

As shown in FIG. 6, in the first embodiment, the frame body 613 which serves as the keycap end 6014 is formed with a slot 613*a*, and the connecting piece 627 is slidably inserted into the slot 613*a* to be movably connected to the frame body 613. During the movement of the first frame 601, the connecting piece 672 is driven by the keycap end 6014 to not only swivel along the up-down direction, but also slide relative to the keycap end 6014, so that the connecting piece 672 will not be stuck on the keycap end 6014 to limit the movement of the first frame 601. The aforesaid first frame 601 can be replaced by the second frame 602. In other words, the slot 631 can be formed on the frame body 623 of the second frame 602, and the connecting piece 672 is movably connected to the keycap end 6024 of the second frame 602. In one or more embodiments, the first frame 601 and the second frame 602 are substantially identical, so the connecting piece 672 can be connected to any one of the keycap ends 6014 and 6024 of the first frame 601 and the second frame 602.

Specifically, the signal generator and the signal sensor (e.g. light emitter 641 and light receiver 642) are arranged along a signal transmission direction. The signal transmission direction is perpendicular to the rotation axis of the pivoting portion 671. The signal generator and the signal sensor are approximately located between the projections of the two keycap ends 6014 and 6024 on the top surface 648*a*. The projection of the arranging direction of the blocking piece 650, the pivoting portion 671, and the connecting piece 672 on the substrate 648 is substantially parallel to the signal transmission direction. The invention does not exclude a tortuous signal path formed through refraction and/or reflection, and the signal path is not limited to a straight line along the signal transmission direction.

As shown in FIG. 2, FIG. 3, and FIG. 6, the blocking mechanism 670 further includes two pivoting tabs 673, which extend from two opposite sides of the pivoting portion 671, respectively. The two pivoting tabs 673 are configured to rotatably position the pivoting portion 671 on the top surface 648*a* along the rotation axis of the pivoting portion 671. The blocking piece 650 and the connecting piece 672 are located at two sides with respect to the rotation axis of the pivoting portion 671. In other words, the blocking piece 650 and the connecting piece 672 substantially extend toward opposite directions. The light receiver 642 which serves as the signal sensor can be located between the two pivoting tabs 673 (i.e., the two pivoting tabs 673 are located at two sides with respect to the signal transmission direction), and the pivoting portion 671 is located over the light receiver 642. Therefore, the pivoting portion 671 and the two pivoting tabs 673 can cover the signal sensor, reducing the interference of external signal to the sensing signal. In the case that the signal sensor is the light receiver 642, the pivoting portion 671 and the two pivoting tabs 673 can shield the external light from above the pivoting portion 671 and outside the two pivoting tabs 673, preventing the external light from interfering with the obtention of the sensing intensity by the light receiver 642. In the case that the signal sensor is the Hall sensor, the pivoting portion 671 and the two pivoting tabs 673 which include magnetically conductive material can shield the magnetic field, reducing the interference of external magnetic field to the Hall sensor.

It is noted that in the embodiments of the invention, the locations of the signal generator and the signal sensor can be interchanged, i.e., the pivoting portion 671 and the two pivoting tabs 673 can be configured to cover the signal generator. In such a case, the external interference to the signal sensor can be reduced by additional elements, such as a shielding member 680 (described later). The pivoting portion 671 and the two pivoting tabs 673 covering the signal generator can reduce the interference of the signal generator to peripheral elements. For example, when the signal generator is a magnet, the pivoting portion 671 and the two pivoting tabs 673 can reduce the interference of magnet to external elements.

As shown in FIG. 2, FIG. 3, and FIG. 4, the backlight source 643 is disposed on the top surface 648*a* of the substrate 648 and configured to emit light toward the keycap 604. In the case that the substrate 648 is a circuit board, the backlight source 643 is electrically connected to the substrate 648 and receives the electric power through the substrate 648. In the case that the substrate 648 is provided without circuitry, the backlight source 643 can receive the electric power through a flexible circuit board or conductive wires. Specifically, the switch module 607, the support mechanism, the blocking mechanism 670, and the backlight source 643 are all located within the projection of the keycap 604 on the substrate 648. When viewing from the top of the keyswitch assembly, the keycap 604 can fully cover the switch module 607, the support mechanism, the blocking mechanism 670, and the backlight source 643. The light-exit region of the keycap 604 is configured to allow light to pass therethrough, so as to illuminate the upper surface of the keycap 604. In a preferred embodiment, the location of the backlight source 643 on the top surface 648*a* corresponds to the light-exit region.

As shown in FIG. 1, FIG. 2, and FIG. 6, in order to further reduce the interference to the signal sensor, the keyswitch assembly further includes a shielding member 680, which is directly or indirectly disposed on the top surface 648*a*. The shielding member 680 has a window 681, and the shielding member 680 surrounds the light emitter 641 and the light receiver 642. The blocking piece 650 can extend through the window 681 to be inserted into the gap between the light emitter 641 and the light receiver 642, so as to block the sensing signal. The pivoting tab 673 is pivotally connected to a pivoting rod 682 of the shielding member 680, so the pivoting tab 682 is pivotally connected to the top surface 648*a* indirectly. In a different embodiment, the pivoting rod 682 can be an element independent from the shielding element 680 and is disposed on the top surface 648*a*.

As shown in FIG. 1 and FIG. 2, the keyswitch assembly further includes a diffusion member 661. The diffusion member 661 is directly or indirectly combined with the top surface 648*a* of the substrate 648. The diffusion member 661 is configured to cover the backlight source 643 and located between the backlight source 643 and the keycap 604. The light emitted from the backlight source 643 can pass through the diffusion member 661 to widely irradiate the bottom surface of the keycap 604. Moreover, the sidewall used to position the diffusion member 661 can be made of light-blocking material to reduce light exiting from the horizontal direction. In the case that the signal sensor is the light receiver 642, the diffusion member 661 can prevent the interference of illumination light to the sensing intensity obtained by the light receiver.

As shown in FIG. 1 and FIG. 2, the shielding member 680 and the diffusion member 661 can be directly combined with the baseplate 603, so as to be indirectly combined with the top surface 648*a* through the baseplate 603. The baseplate 603 is provided with first engaging portions 691. The shielding member 680 and the diffusion member 661 are provided with second engaging portions 692. The first engaging portion 691 and the second engaging portion 692 are matched to each other to fix the shielding member 680 and the diffusion member 661 on the baseplate 603. For example, as shown in the drawings, the second engaging portion 692 on the diffusion member 661 is a protrusion, and its corresponding first engaging portion 691 is a lug, which protrudes upward from the baseplate 603 and has a hole. The second engaging portion 692 on the shielding member 680 is a protrusion and a hook hole, and its corresponding first engaging portion 691 is a lug with a hole and a hook protruding upward from the baseplate 603.

Figure 5:
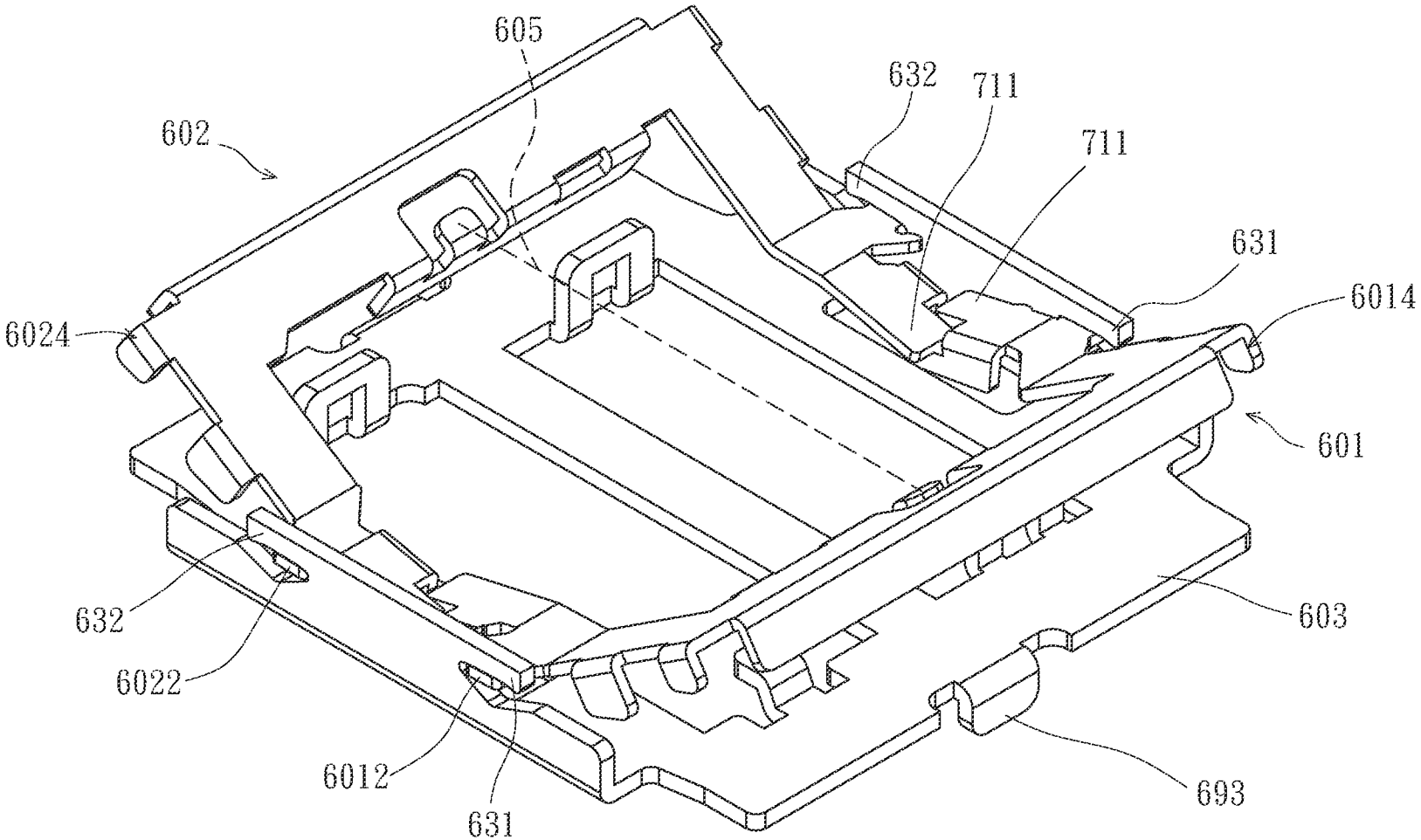
FIG. 5 is a three-dimensional view of the baseplate and two frames in the first embodiment of the invention.

As shown in FIG. 4 and FIG. 5, the resilient member 605 is represented by a dashed line. The resilient member 605 traversely connects the keycap ends 6014 and 6024 of the first frame 601 and the second frame 602 along a connecting direction. The orthographic projection of the resilient member 605 divides the keycap projection area 604*a* of the keycap 604 on the top surface 648*a* of the substrate 648 into a first region 604*a*1 and a second region 604*a*2. The signal generator (e.g. light emitter 641) and the signal sensor (e.g. light receiver 642) are disposed on the first region 604*a*1, and the backlight source 643 is disposed on the second region 604*a*2. The blocking and reflection of the resilient member 605 can reduce the intensity of illumination light in the second region 604*a*2, so as to reduce the interference of the illumination light to the signal sensor (e.g. light receiver 642). When the signal generator and the signal sensor is a magnetic switch constituted by the magnet and the Hall sensor, the resilient member 605 can be made of magnetically conductive material (e.g. iron, cobalt, nickel, or alloys thereof), so that the resilient member 605 can block the magnetic field to prevent the change of the magnetic field generated when the backlight source 643 is switched off/on to interfere with the Hall sensor.

As shown in FIG. 1, FIG. 2, FIG. 3, and FIG. 4, the baseplate 603 has a claw portion 693, and the substrate 648 has a corresponding hole 694. The claw portion 693 can be inserted into the hole 694 and engage with the edge of the hole 694, so as to fix the baseplate 603 on the top surface 648*a* of the substrate 648. Based on the detachable baseplate 603, the support mechanism, the blocking mechanism 670, the shielding member 680, and the diffusion member 661 can be pre-assembled as a sub-assembly. After the baseplate 603 is mounted on the substrate 648 through the positioning of the hole 694, the positioning of the sub-assembly can be completed, especially the positioning of the blocking piece 650 to the signal generator and the signal sensor. The keycap 604 can be pre-mounted on the sub-assembly. Alternatively, the keycap 604 can be mounted on the sub-assembly after the sub-assembly is positioned on the substrate 648. Practically, the baseplate 603 occupies a relatively small area of the substrate 648 for mounting the support mechanism, the blocking mechanism 670, the shielding member 680, and the diffusion member 661 thereon, and each keyswitch assembly can be provided a single independent baseplate 603, but not limited thereto. In another embodiment, the baseplates 603 of multiple keyswitch assemblies can be interconnected to form an integral baseplate of large area.

Figure 7:
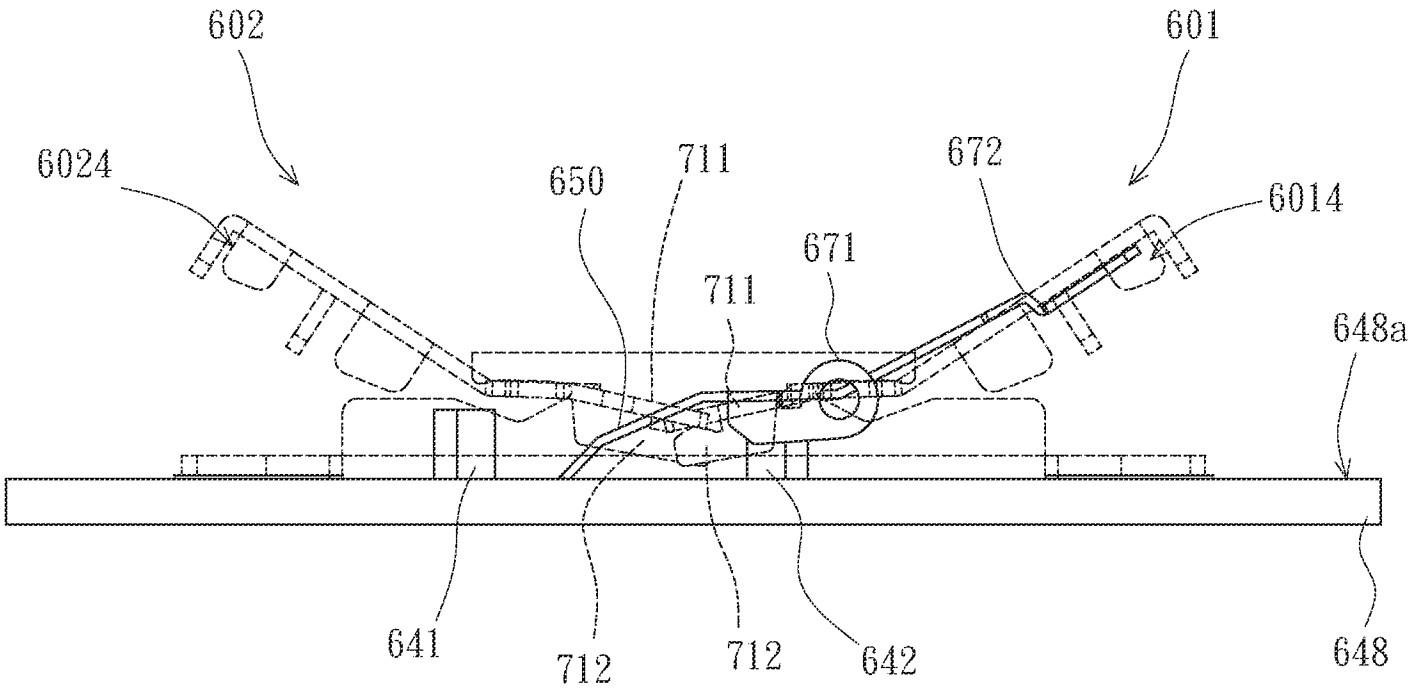
FIG. 7 and FIG. 8 are side views of the switch module, two frames, and the blocking mechanism in the first embodiment of the invention.
Figure 8:
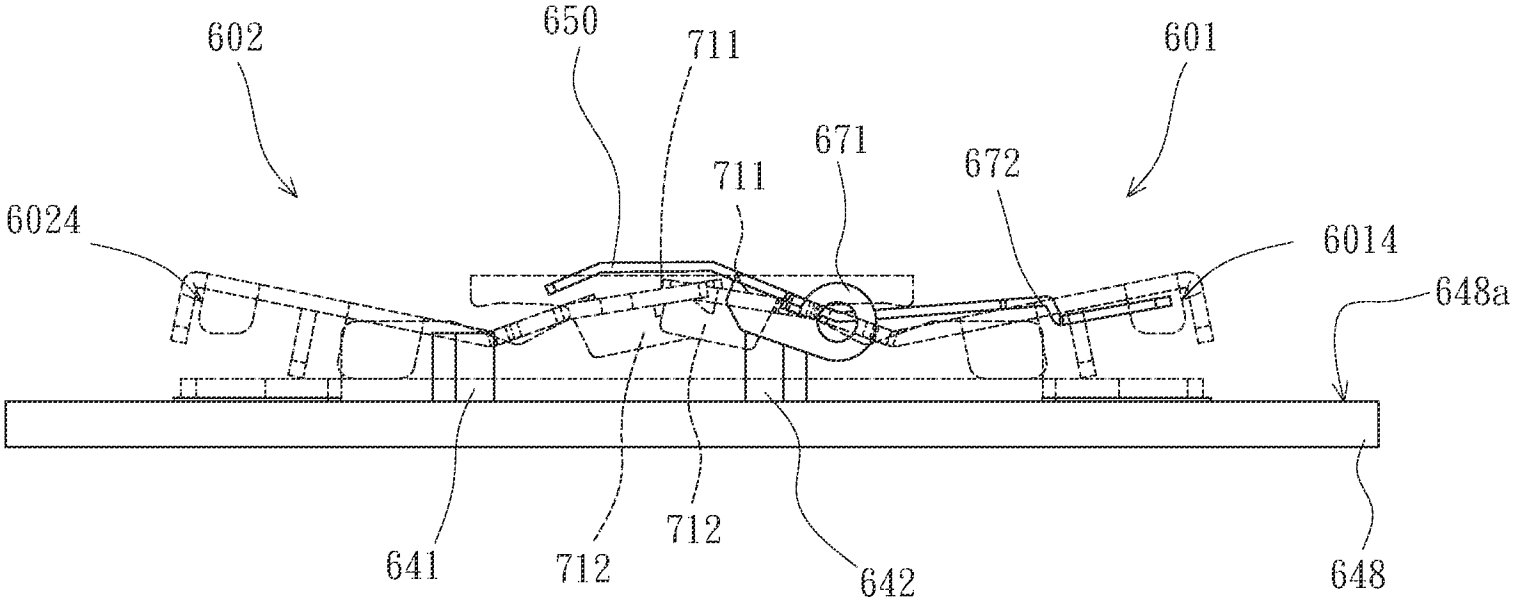

FIG. 7 and FIG. 8 are simplified to merely show the substrate 648, the light emitter 641, the light receiver 642, the first frame 601, the second frame 602, and the blocking mechanism 670. As shown in the drawings, the projection of the blocking piece 650 on the substrate 648 is substantially located between the light emitter 641 and the light receiver 642. One of the light emitter 641 and the light receiver 642 is located between the projections of the blocking piece 650 and the connecting piece 672 on the substrate 648. In the direction perpendicular the top surface 648*a* of the substrate 648, the blocking mechanism 670 rotates about its rotation axis, and the linear movement directions of the blocking piece 650 and the connecting piece 672 are opposite. Moreover, the front end of the blocking piece 650 is bent toward the substrate 648, so that the distance between the front end of the blocking piece 650 and the top surface 648 is reduced.

FIG. 7 shows that the keycap 604 (not shown) is in a non-pressed state, in which the pulling force provided by the resilient member 605 enables the two keycap ends 6014 and 6024 to approach each other and move upward, so as to drive the keycap 604 to move upward to the highest point that can be reached in this embodiment. In such a configuration, like a seesaw, the part of the connecting piece 672 connected to the keycap end 6014 moves upward to drive the front end of the blocking piece 650 to move downward in the opposite direction to the lowest point, and the front end of the blocking piece 650 is inserted into the gap between the light emitter 641 and the light receiver 642. The front end of the blocking piece 650 blocks the transmission of the sensing signal, and the sensing intensity obtained by the signal sensor (e.g. light receiver 642) is the first intensity. The first intensity is usually the smallest sensing intensity in the first embodiment. However, the value of the first intensity is not necessarily equal to zero, because when the keycap 604 is located at the highest point (i.e., the blocking piece 650 is located at the lowest point), the transmission of the sensing signal is not necessarily completely blocked by the blocking piece 650.

FIG. 8 shows the state that the keycap 604 (not shown) is pressed to the lowest point, in which the keycap 604 is pressed and moves downward to transfer the pressing force to the two keycap ends 6014 and 6024 and to drive the two keycap ends 6014 and 6024 to move downward to the lowest point. The two keycap ends 6014 and 6024 move downward away from each other, so the resilient member 605 is stretched to generate an elastic restoring force, and the elastic restoring force is a pulling force. Meanwhile, the part of the connecting piece 672 connected to the keycap end 6014 moves downward to drive the front end of the blocking piece 650 to move upward in the opposite direction to the highest point that can be reached in this embodiment. The front end of the blocking piece 650 can completely or partially escape from the gap between the light emitter 641 and the light receiver 642, so that the degree of blocking the sensing signal can be reduced. In such a configuration, the sensing intensity obtained by the signal sensor (e.g. light receiver 642) is increased to the second intensity, and a trigger event is generated.

The aforesaid trigger event (i.e., the sensing intensity is changed from the first intensity to the second intensity) can be interpreted as an input trigger by the backend processing circuit, so as to generate a corresponding input signal.

As shown in FIG. 8, it is noted that in the descriptions of the previous embodiment, the trigger event is generated when the keycap 604 and the two key cap ends 6014 and

6024 are pressed to the lowest point, i.e., the second intensity is defined as the largest sensing intensity that can be obtained in the first embodiment, but not limited thereto. Practically, in consideration of the sensitivity of the keyswitch assembly, the pressing-type input device (e.g. keyboard) is generally not configured to generate the trigger event when the keycap 604 is pressed to the lowest point. Generally, the pressing-type input device generates the trigger event when the keycap 604 is pressed downward by an appropriate distance during the pressing stroke, such as half of the maximum stroke. Therefore, in the first embodiment, the second intensity can be a specified upper threshold value of intensity, and the value can be set between the first intensity and the maximum sensing intensity. When the sensing intensity is gradually increased from the first intensity to the second intensity, the trigger event will be generated. When the keycap 604 continues to be pressed and moves downward, the sensing intensity may continue to be increased, so that the trigger event maintains the existing state and is not judged as a new trigger event. When the keycap 604 is released and moves upward so that the sensing intensity is decreased to less than the second intensity, the processing device determines that the aforementioned trigger event is terminated.

Figure 9:
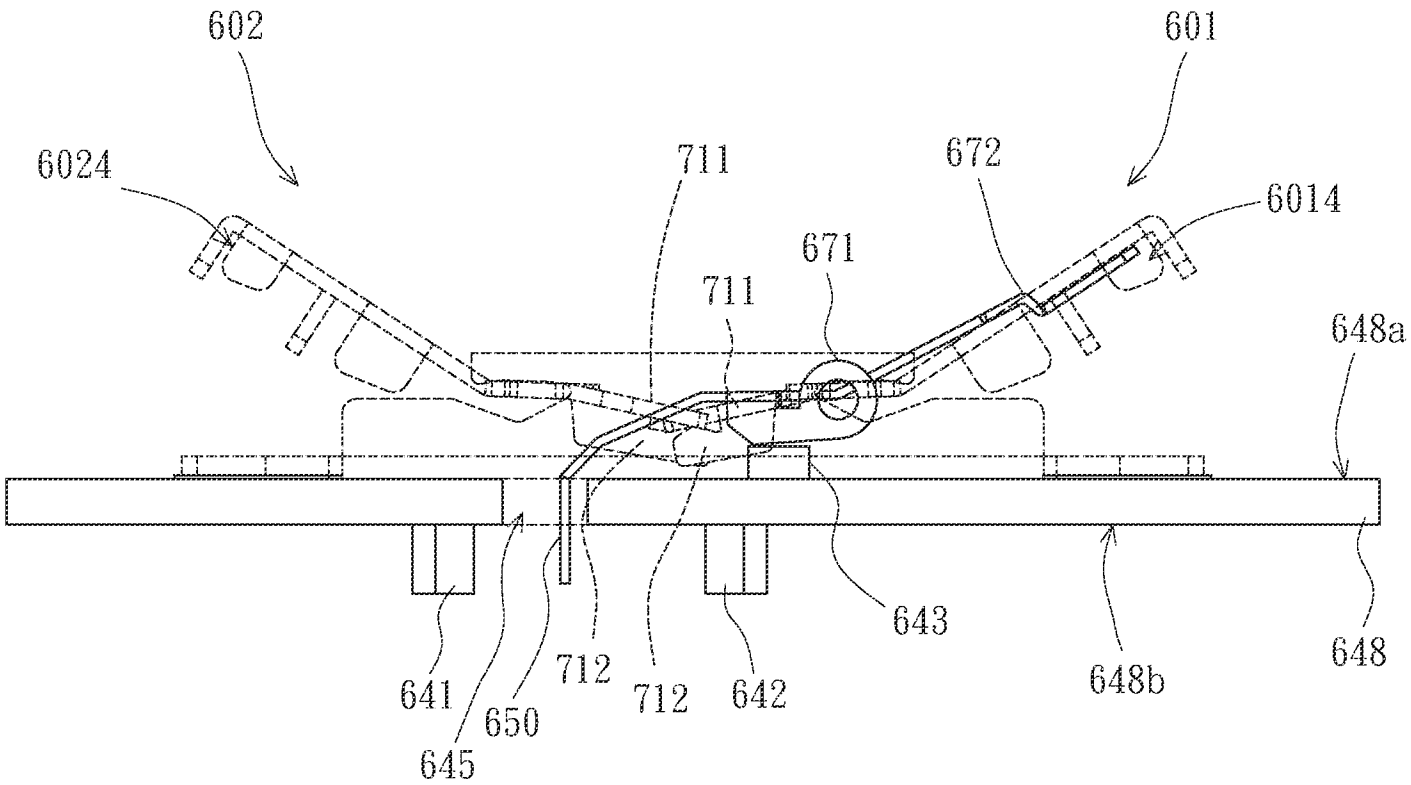
FIG. 9 and FIG. 10 are side views of the backlight source, the switch module, and two frames in a variant embodiment of the first embodiment of the invention.
Figure 10:
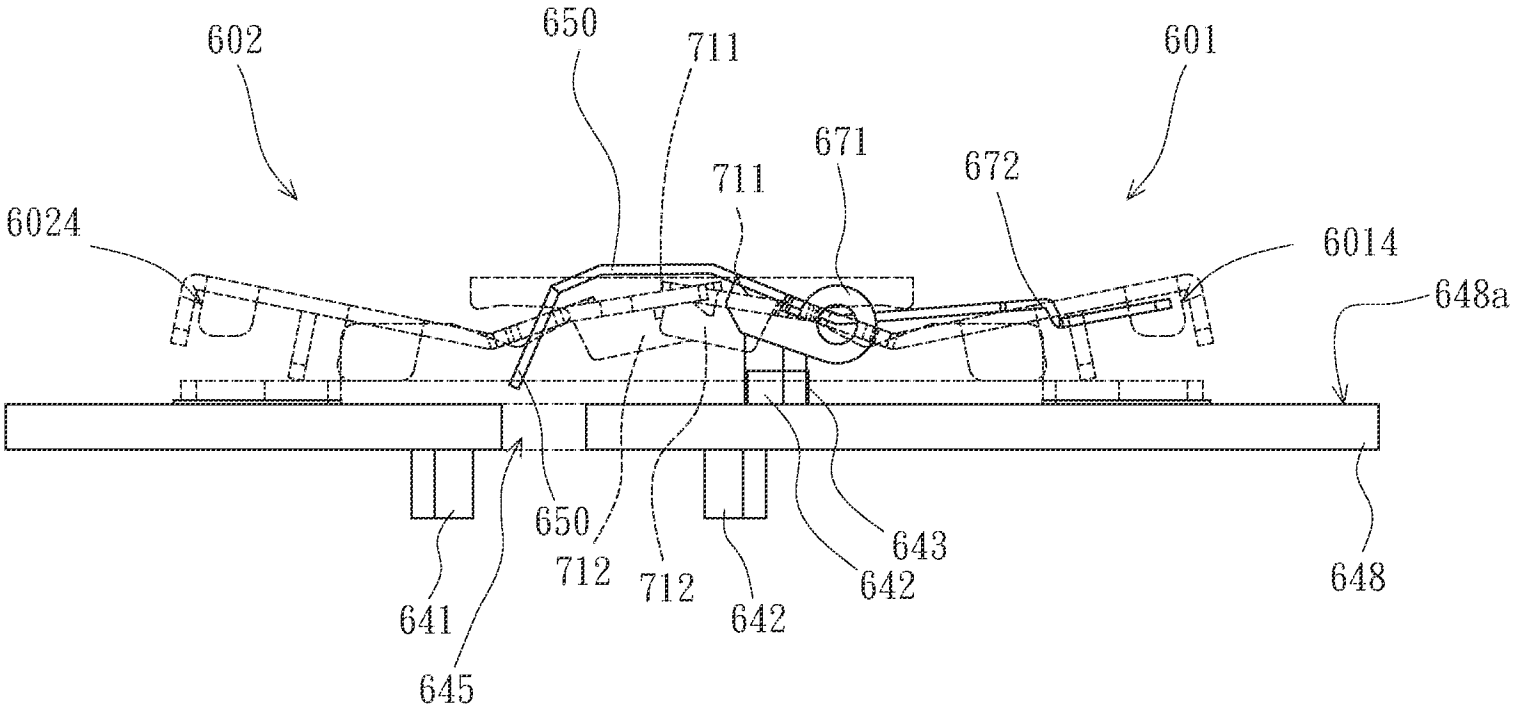

FIG. 9 and FIG. 10 show a variant embodiment of the first embodiment. In this embodiment, the support mechanism and the backlight source 643 are disposed on the top surface 648*a* of the substrate, and the signal generator (e.g. light emitter 641) and the signal sensor (e.g. light receiver 642) are disposed on the bottom surface 648*b* of the substrate 648. In other words, the optical switch and the backlight source 643 are disposed on different surfaces of the substrate 648. The substrate 648 has a groove 645. The signal generator and the signal sensor are respectively disposed on two sides with respect to the groove. As shown in FIG. 9, the width and length of the groove 645 match the size and shape of the blocking piece 650, and the front end of the blocking piece 650 is bent downward and points to the groove 645. When the keycap 604 is not pressed, the blocking piece 650 can extend through the groove 650 into the gap between the signal generator and the signal sensor. As shown in FIG. 10, when the keycap 604 is pressed, and the support mechanism drives the blocking piece 650 to rise, the blocking piece 650 escapes from the groove 645 and the gap between the signal generator and the signal sensor, so as to change the magnitude of the sensing intensity. In the variant embodiment, the optical switch and the backlight source 643 are disposed on different surfaces, so that the interference of the backlight source 643 to the signal sensor (e.g. the light receiver 642) can be reduced. In the case that the optical switch is replaced by the magnetic switch, the configuration that the magnetic switch and the backlight source 643 are disposed on different surfaces can also reduce the interference to the signal sensor caused by the change of magnetic field generated when the backlight source 643 is operated.

Figure 11:
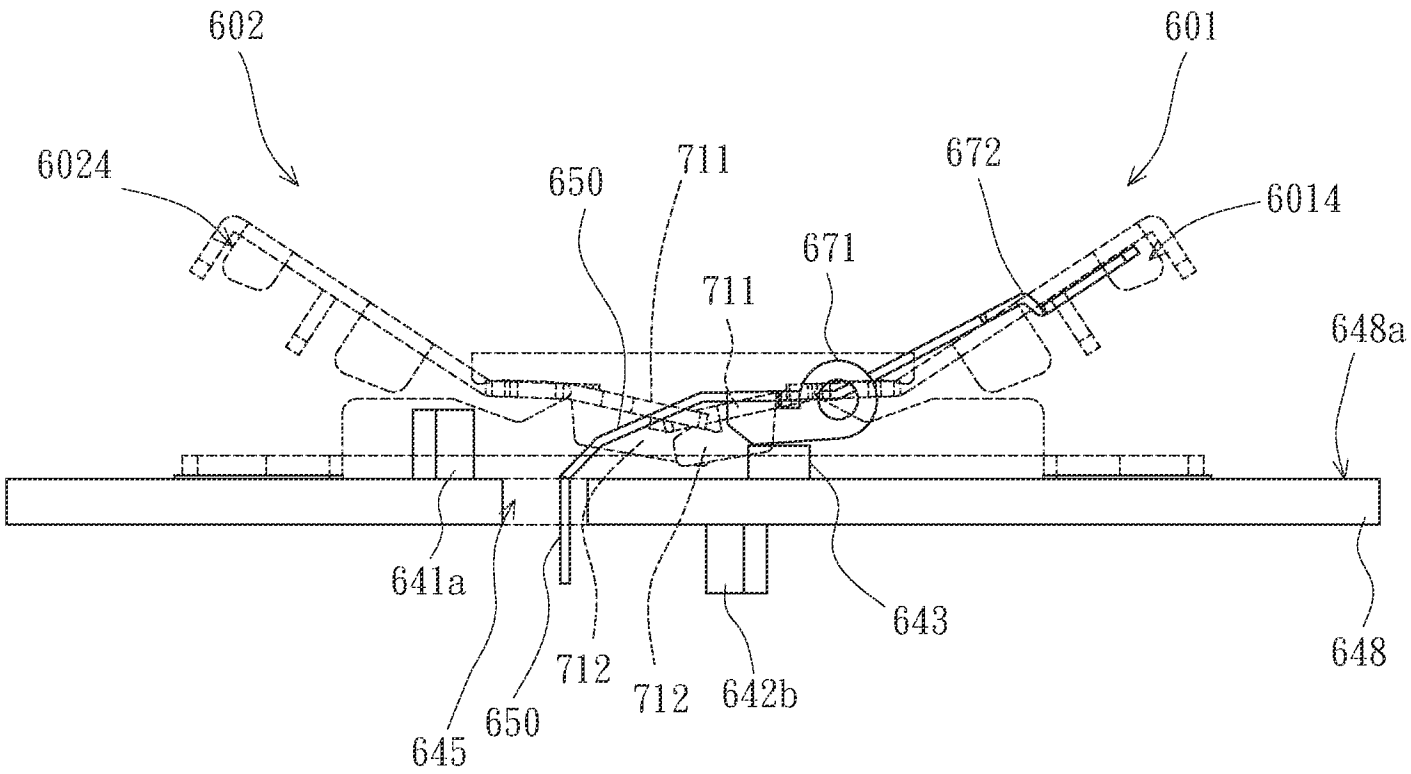
FIG. 11 is side views of the backlight source, the switch module, two frames, and the blocking mechanism in another variant embodiment of the first embodiment of the invention.

FIG. 11 shows another variant embodiment of the first embodiment. When the signal generator and the signal sensor are the magnetic switch constituted by the magnet 641*a* and the Hall sensor 642*a*, the magnet 641*a* and the Hall sensor 642*a* can be disposed on different surfaces. For example, the magnet 641*a* and the backlight source 643 are disposed on the top surface 648*a*, and the Hall sensor 642*a* is disposed on the bottom surface 648*b*. Though the magnet 641*a* and the Hall sensor 642*a* are separated by the substrate 648, the magnet 641*a* and the Hall sensor 642*a* can still form a stable magnetic field due to the existence of the groove 645. Similarly, when the keycap 604 is not pressed, the blocking piece 650 can extend through the groove 650 into the gap between the magnet 641*a* and the Hall sensor 642*a*, so that the sensing intensity obtained by the Hall sensor can be reduced to the smallest. When the keycap 604 is pressed, and the support mechanism drives the blocking piece 650 to rise, the blocking piece 650 escapes from the groove 645 and the gap between the signal generator and the signal sensor, so as to change the magnitude of the sensing intensity. In this variant embodiment, the locations of magnet 641*a* and the Hall sensor 642*a* can be interchanged.

In general, when the user presses the keycap 604, the user may not necessarily press the center of the keycap 604. For example, when the edge portion of the keycap 604 is pressed, the keycap 604 will be inclined, and the pressing force is concentratedly transferred to the keycap end 6024 of the second frame 602. As such, the keycap end 6024 of the second frame 602 obviously bears a larger pressing force, and the keycap end 6014 of the first frame 601 bears a relatively lower pressing force. In such a situation, the first frame 601 and the second frame 602 cannot move in a linking manner, resulting in inconsistent strokes of the downward movement of the two keycap ends 6014 and 6024 and affecting the generation of the trigger event. In other words, when the user makes a sufficient pressing stroke, the keycap end 6014 of the first frame 601 does not generate the same downward movement stroke, so that the sensing intensity cannot reach the second intensity to generate the trigger event.

Figure 12:
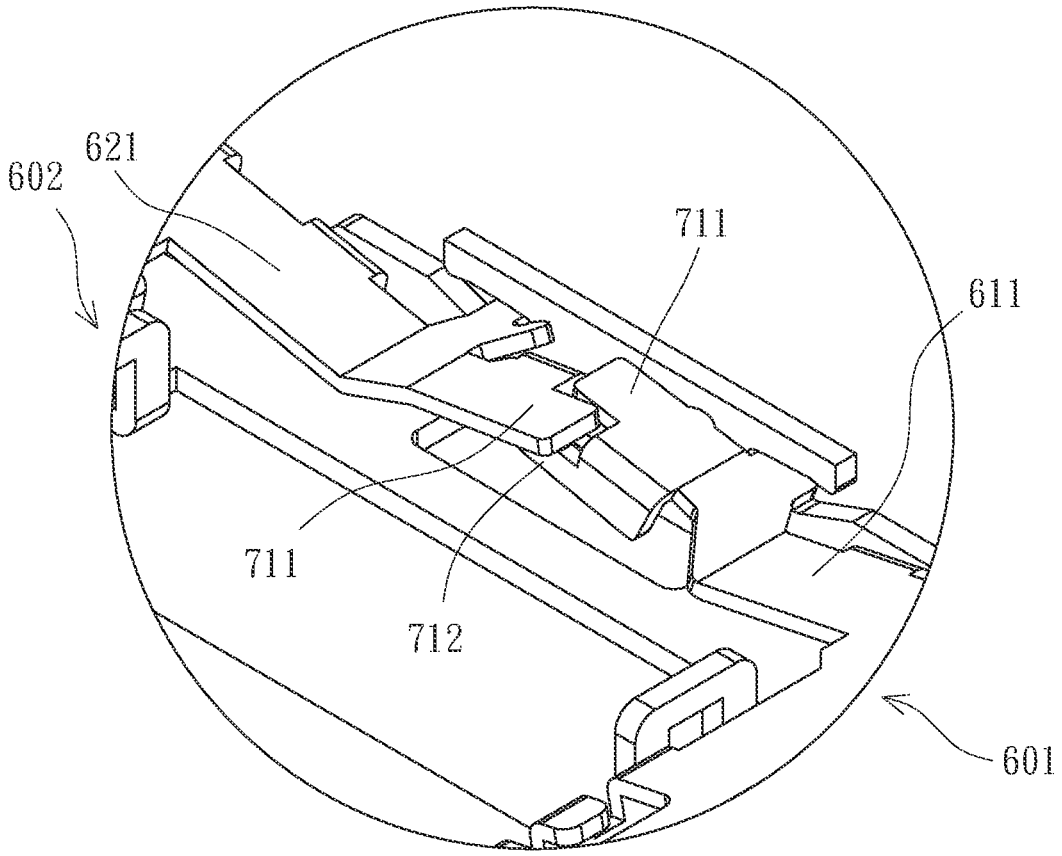
FIG. 12 is a partially enlarged exploded view of the linkage mechanism in the first embodiment of the invention.

As shown in FIG. 5, FIG. 12, and FIG. 11, in one or more embodiments, a linkage mechanism is disposed between the first frame 601 and the second frame 602.

As shown in the drawings, a front end of each of side arms 611, 612, 621, and 622 is provided with a pressing piece 711 and a receiving piece 712. The pressing piece 711 and the receiving piece 712 extend outward along the longitudinal direction of the corresponding side arm 611, 612, 621, or 622 and are arranged side by side.

As shown in FIG. 5, FIG. 12, and FIG. 11, when the baseplate ends 6012 and 6022 of the first frame 601 and the second frame 602 are movably connected to the substrate 648, the front end of each of the side arms 611 and 612 of the first frame 601 respectively correspond to the front end of each of the side arms 621 and 622 of the first frame 602. With respect to the substrate 648, the pressing piece 711 of the first frame 601 is positioned over the receiving piece 712 of the second frame 602, and the pressing piece 711 of the second frame 602 is positioned over the receiving piece 712 of the first frame 601.

Referring again to FIG. 5, the two side arms 611 and 612 of the first frame 601 and the two side arms 621 and 622 of the second frame 602 can all be provided with the pressing pieces 711 and the receiving pieces 712 at the same time, and two sets of the pressing pieces 711 and the receiving pieces 712 are in the same relative position configuration. For example, as shown in the drawings, the pressing piece 711 is located at the lefthand side, and the receiving piece 712 is located at the righthand side. When the first frame 601 and the second frame 602 have the same configuration, the first frame 601 can horizontally rotate 180 degrees to act as the second frame 602. Therefore, there is no need to separately manufacture different types of the first frame 601 and the second frame 602.

Figure 13:
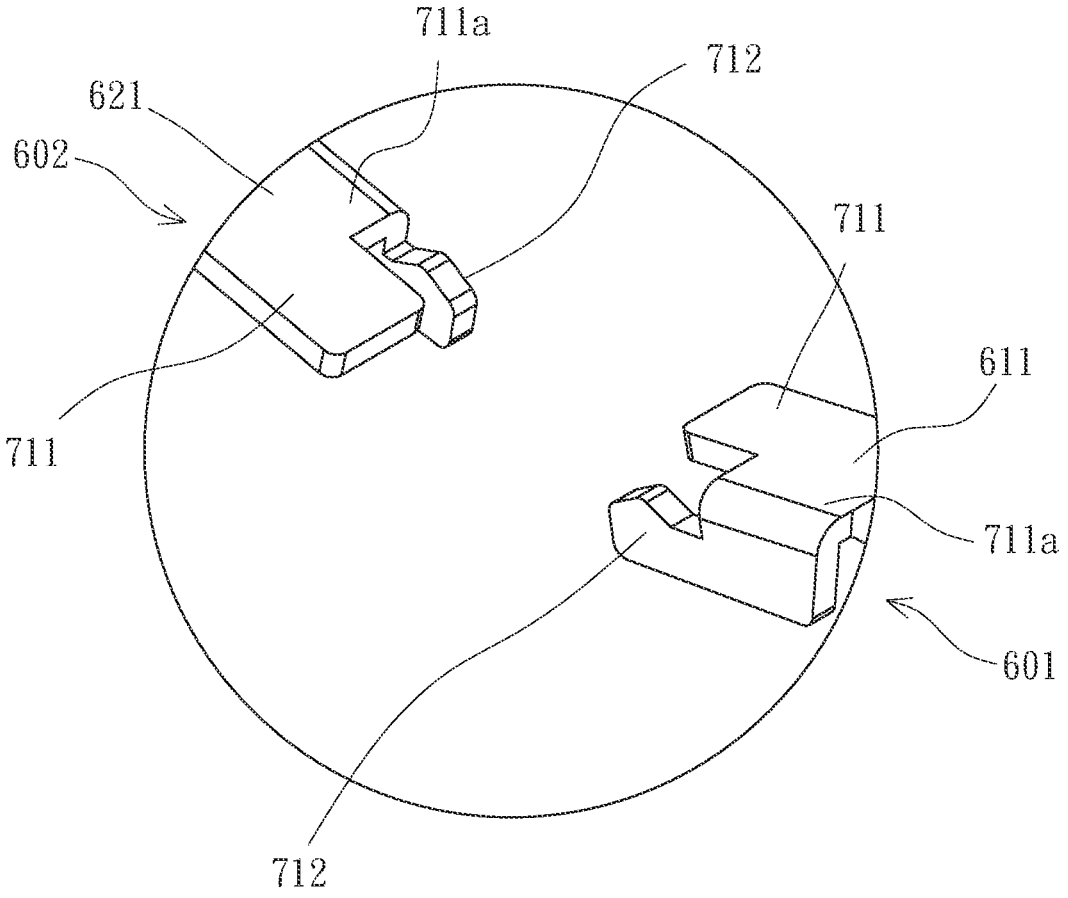
FIG. 13 is a partially enlarged view of the linkage mechanism in the first embodiment of the invention.

As shown in FIG. 12 and FIG. 13, an extension portion 711*a* laterally extends from the pressing piece 711, and a distal end of the extension portion 711*a* is bent downward and extends forward to form the receiving piece 712. The receiving piece 712 is a longitudinal strip disposed vertical to the substrate 648, and the pressing piece 711 is perpendicular to the receiving piece 712. Substantially, the front end of the upper edge of the receiving piece 712 extends upward and has a rounded corner at the junction of the edges. The pressing piece 711 can extend horizontally without bending.

With respect to the substrate 648, the front end of the upper edge of the receiving piece 712 of the first frame 601 is located under the pressing piece 711 of the second frame 602. The front end of the upper edge of the receiving piece 712 of the second frame 602 is located under the pressing piece 711 of the first frame 601. Similar to the previous embodiment, the two side arms 611 and 612 of the first frame 601 and the two side arms 621 and 622 of the second frame 602 can all be provided with the pressing pieces 711 and the receiving pieces 712 at the same time, and two sets of the pressing pieces 711 and the receiving pieces 712 are in the same relative position configuration. In general, the length of the pressing piece 711 is configured in a manner that when the first frame 601 and the second frame 602 are coplanar, the front end of the pressing piece 711 will not contact the extension portion 711*a*.

Referring to FIG. 8, when the pressing force is exerted to the upper surface of the keycap 604, and the external force is assumed to be concentrated on the second frame 602, the upward movement of the receiving portion 712 of the second frame 602 can push the pressing piece 711 of the first frame 601 upward, so as to drive the first frame 601 to move. At the same time, the receiving portion 712 of the first frame 601 will also push the pressing piece 711 of the second frame 602, so as to drive the second frame 602 to move. Accordingly, the pressing force concentrated on the second frame 602 can be distributed to the first frame 601 and the second frame 602, so the two keycap ends 6014 and 6024 can move downward by a substantially same stroke, and the keycap 604 will remain stable without skewing. In the aforesaid descriptions, the first frame 601 and the second frame 602 can be replaced by each other. In other words, when the external force is concentrated on the first frame 601, the second frame 602 can be driven through the same linkage mechanism. As such, the keycap 604 and the two keycap ends 6014 and 6024 can move downward by a substantially same stroke without interfering the generation of the trigger event.

As shown in FIG. 12, when the pressing force applied to the upper surface of the keycap 604 is released, and the two keycap ends 6014 and 6024 approach each other and move upward through the pulling force of the resilient member 605, the linking relationship is that the pressing piece 711 presses the corresponding receiving portion 712 downward to balance the pulling force of the resilient member 605 between the first frame 601 and the second frame 602.

As such, no matter the keycap 604 moves upward or downward, the first frame 601 and the second frame 602 move in a linking manner, and the force on the first frame 601 and the second frame 602 is balanced to reduce the interference to the generation of the trigger event due to the skew of the keycap 604 during the pressing/releasing process.

Figure 14:
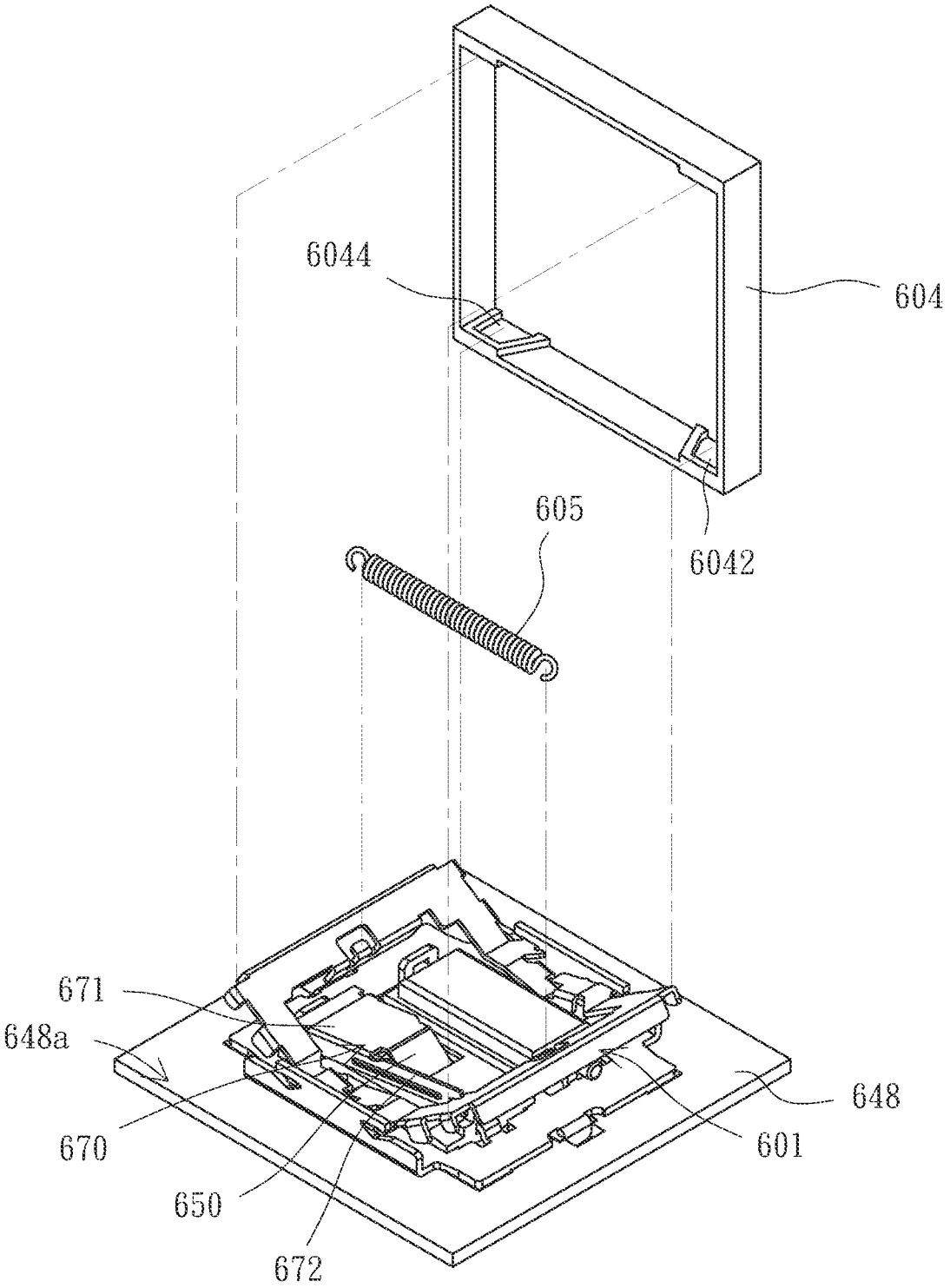
FIG. 14 is a partially exploded view of the keyswitch assembly in a second embodiment of the invention.
Figure 15:
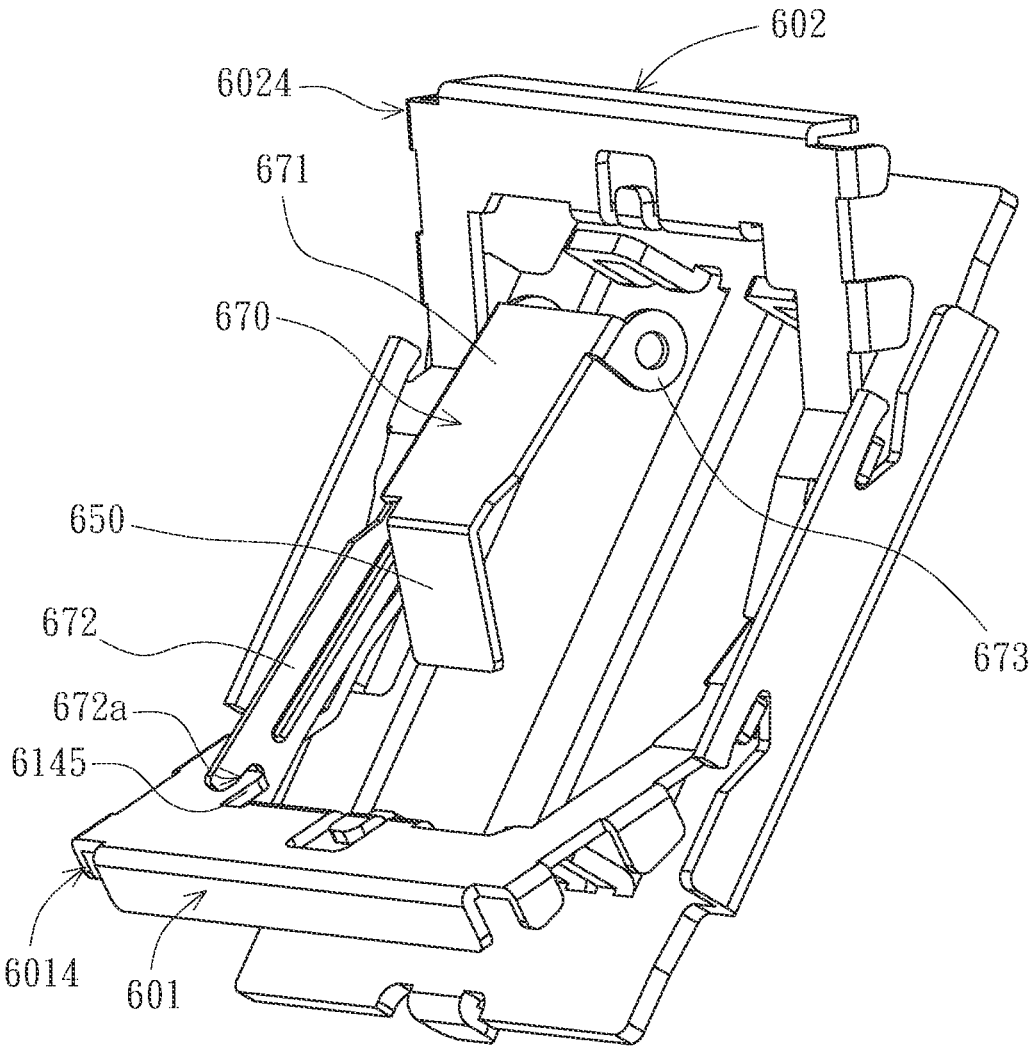
FIG. 15 is a three-dimensional view of the baseplate, two frames, and the blocking mechanism in the second embodiment of the invention.

Referring to FIG. 14 and FIG. 15, in a second embodiment, the invention discloses a keyswitch assembly, which is provided for explaining a variant embodiment of the blocking mechanism.

As shown in FIG. 14 and FIG. 15, the blocking mechanism 670 includes a pivoting portion 671, a connecting piece 672, and a blocking piece 650. The pivoting portion 671 is rotatably disposed on the top surface 648*a* of the substrate 648. The rotation axis of the pivoting portion 671, the rotation axis of the first frame 601, and the rotation axis of the second frame are substantially parallel.

As shown in FIG. 14 and FIG. 15, the connecting piece 672 extends from the pivoting portion 671, and in the second embodiment, the connecting piece 672 is a longitudinal strip disposed vertical to the top surface 648*a*. The distal end of the connecting piece 672 has a notch 672*a*. The opening of the notch 672*a* is located at the distal end of the connecting piece 672. The notch 672*a* extends toward the pivoting portion 671, and the edge around the opening has a rounded corner. Correspondingly, one of the keycap ends 6014 and 6024 has a guiding piece 6145 (taking the keycap end 6014 of the first frame 601 as an example).

As shown in FIG. 14 and FIG. 15, the guiding piece 6145 is a plate body, which is perpendicular to the connecting piece 672 and configured to be inserted into the notch 672*a*. The width of the notch 672*a* is larger than the thickness of the guiding piece 6145. The guiding piece 6145 can be slidable in the notch 672*a* and also swivels in the width direction of the notch 672*a*, so that the connecting piece 672 is movably connected to the keycap end 6014 of the first frame 601. In this embodiment, the slot 613*a* provided on the frame body 613 can be omitted. Specifically, the guiding piece 6145 is disposed on the frame body 613/623, which serves as the keycap end 6014/6024.

Figure 16:
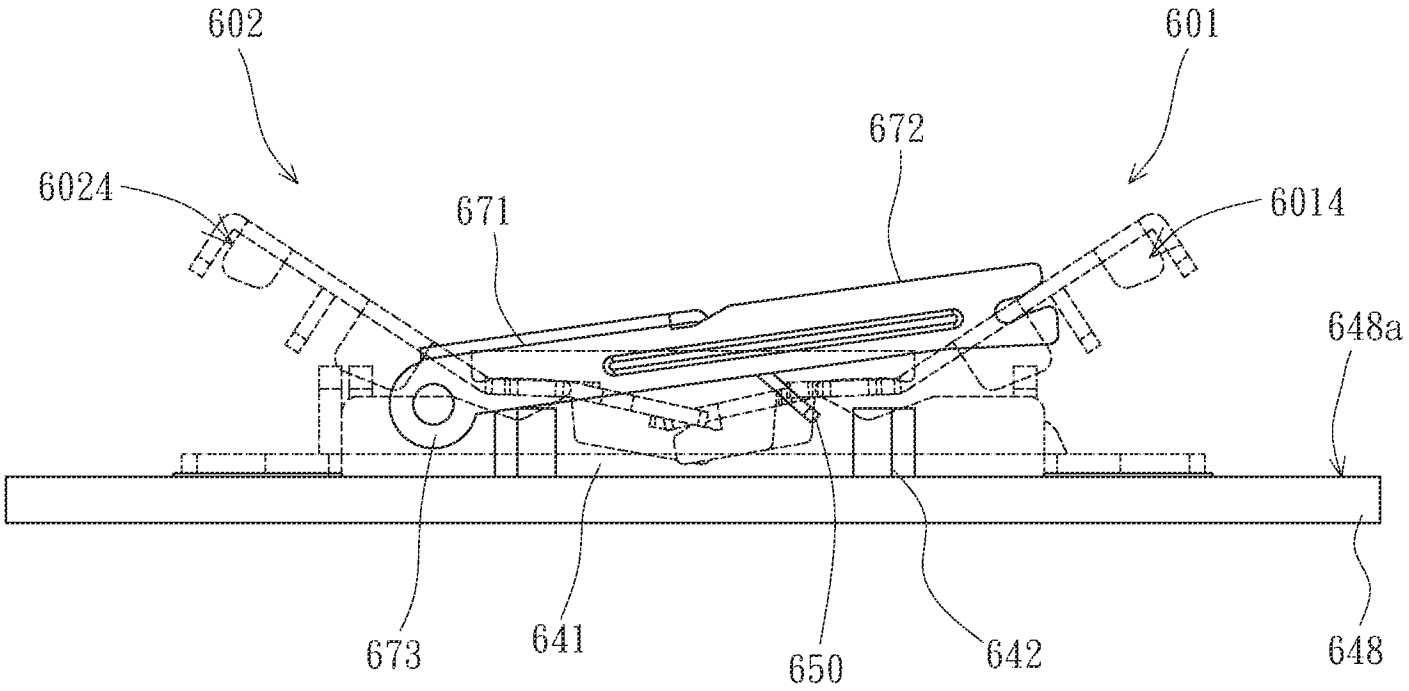
FIG. 16 and FIG. 17 are side views of the switch module, two frames, and the blocking mechanism in the second embodiment of the invention.
Figure 17:
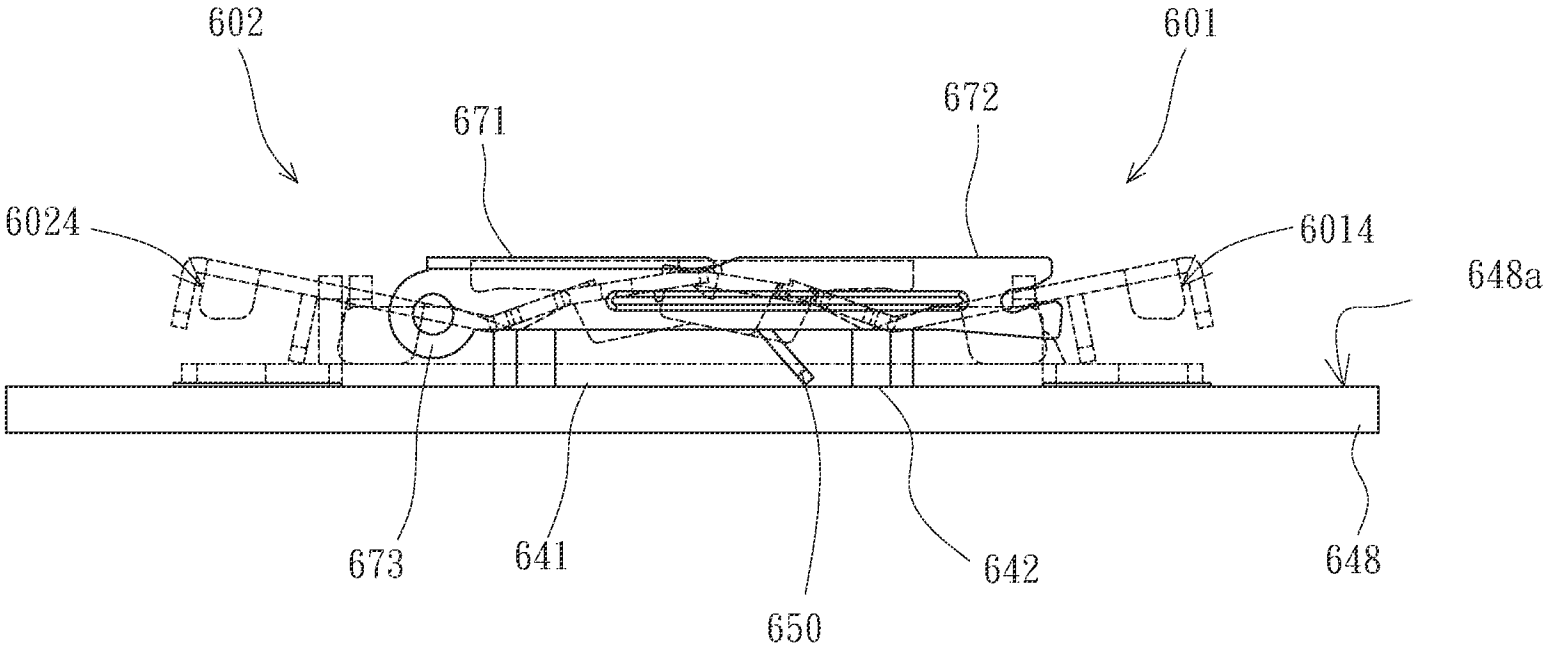

As shown in FIG. 16 and FIG. 17, FIG. 16 and FIG. 17 are simplified to merely show the substrate 648, the light emitter 641, the light receiver 642, the first frame 601, the second frame 602, and the blocking mechanism 670. In the second embodiment, with respect to the rotation axis of the pivoting portion 671, the connecting piece 672 and the blocking piece 650 extend toward the same side, and the distal end of the blocking piece 650 is substantially located between the distal end of the connecting piece 672 and the pivoting portion 671. One of the light emitter 641 and the light receiver 642 can be located between the two pivoting tabs 673. In other words, the two pivoting tabs 673 are located at two sides with respect to the signal transmission direction. The pivoting portion 671 is located over one of the light emitter 641 and the light receiver 642, and the other of the light emitter 641 and the light receiver 642 is located between projections of distal end of the blocking piece 650 and the distal end of the connecting piece 672 on the top surface 648*a*. Similarly, in the second embodiment, the locations of the light emitter 641 and the light receiver 642 which function as the signal generator and the signal receiver can be interchanged.

As shown in FIG. 16 and FIG. 17, in the direction perpendicular to the top surface 648*a* of the substrate 648, the blocking mechanism 670 rotates about the rotation axis of the pivoting portion 671, and the linear movement directions of the blocking piece 650 and the connecting piece 672 are the same. Moreover, the front end of the blocking piece 650 can be bent toward the substrate 648 to decrease the distance between the front end of the blocking piece 650 and the top surface 648*a*.

FIG. 16 shows that the keycap 604 (not shown) is in a non-pressed state, in which the pulling force provided by the resilient member 605 enables the two keycap ends 6014 and 6024 to approach each other and move upward, so as to drive the keycap 604 to move upward to the highest point that can be reached in this embodiment. The part of the connecting piece 672 connected to the keycap end 6014 moves upward to drive the front end of the blocking piece 650 to move upward to the highest point, and the front end of the blocking piece 650 escapes from the gap between the light emitter 641 and the light receiver 642. As such, the front end of the blocking piece 650 does not block the transmission of the sensing signal, or the blocking of the sensing signal by the blocking piece 650 is reduced to a minimum degree. The sensing intensity obtained by the light receiver 642 is the first intensity. The first intensity is usually the largest sensing intensity in the second embodiment. However, the value of the first intensity is not necessarily equal to the maximum sensing intensity that the sensing sensor can obtain, because when the keycap 604 is located at the highest point, and the blocking piece 650 is located at the highest point, the transmission of the sensing signal may be partially blocked by the blocking piece 650.

FIG. 17 shows the state that the keycap 604 (not shown) is pressed to the lowest point, in which the keycap 604 is pressed and moves downward to transfer the pressing force to the two keycap ends 6014 and 6024 and to drive the two keycap ends 6014 and 6024 to move downward to the lowest point. Meanwhile, the part of the connecting piece 672 connected to the keycap end 6014 moves downward to drive the front end of the blocking piece 650 to move downward to be inserted into the gap between the light emitter 641 and the light receiver 642 to the lowest point that can be reached in this embodiment, so that the degree of blocking the sensing signal can be increased. In such a configuration, the sensing intensity obtained by the light receiver 642 is decreased to the second intensity, and a trigger event is generated. The trigger event can be interpreted as an input trigger by the processing circuit, so as to generate a corresponding input signal.

As shown in FIG. 17, it is noted that in the descriptions of the previous embodiment, the trigger event is generated when the keycap 604 and the two keycap ends 6014 and 6024 are pressed to the lowest point, i.e., the second intensity is defined as the smallest sensing intensity that can be obtained in the second embodiment, but not limited thereto. Practically, the second intensity can be a specified lower threshold value of intensity, and the value can be set between the first intensity and the smallest sensing intensity. When the sensing intensity is gradually reduced from the first intensity to the second intensity (or less than the second intensity), the trigger event will be generated. When the keycap 604 continues to be pressed and moves downward, the sensing intensity may continue to be decreased, so that the trigger event maintains the existing state and is not judged as a new trigger event. When the keycap 604 is released so that the sensing intensity is increased to larger than the second intensity, the processing device determines that the aforementioned trigger event is terminated.

Figure 18:
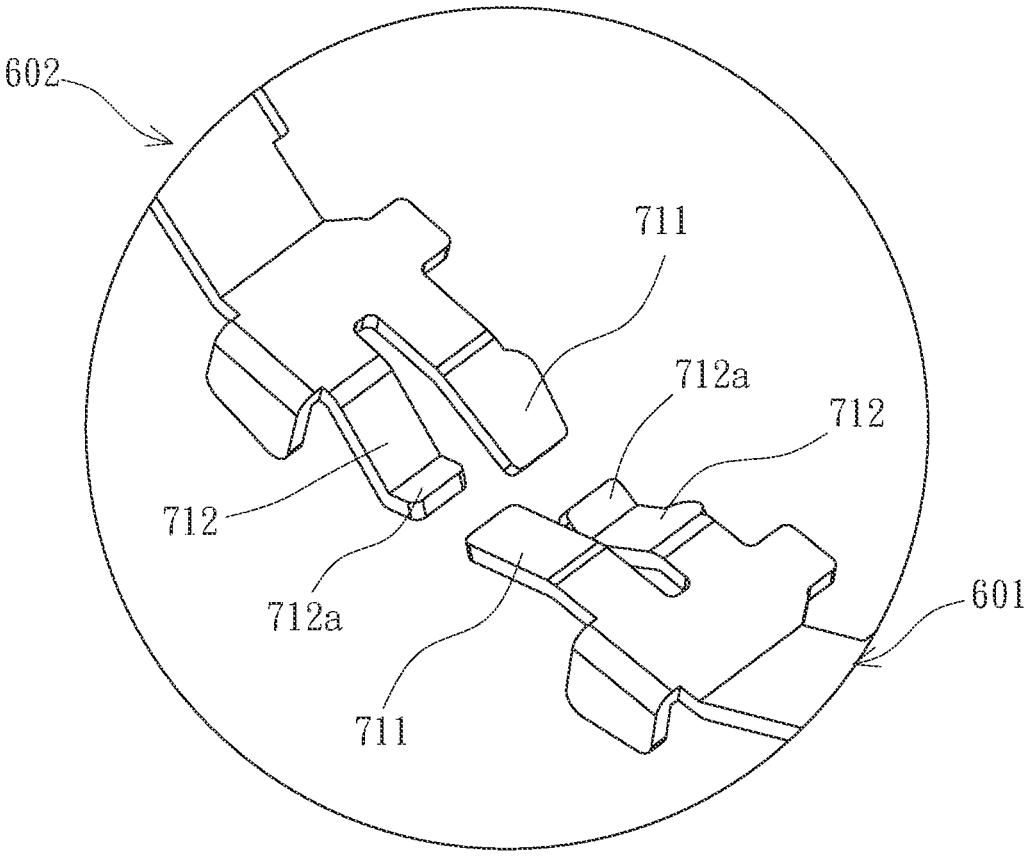
FIG. 18 is a partially enlarged exploded view of the linkage mechanism in a third embodiment of the invention.
Figure 19:
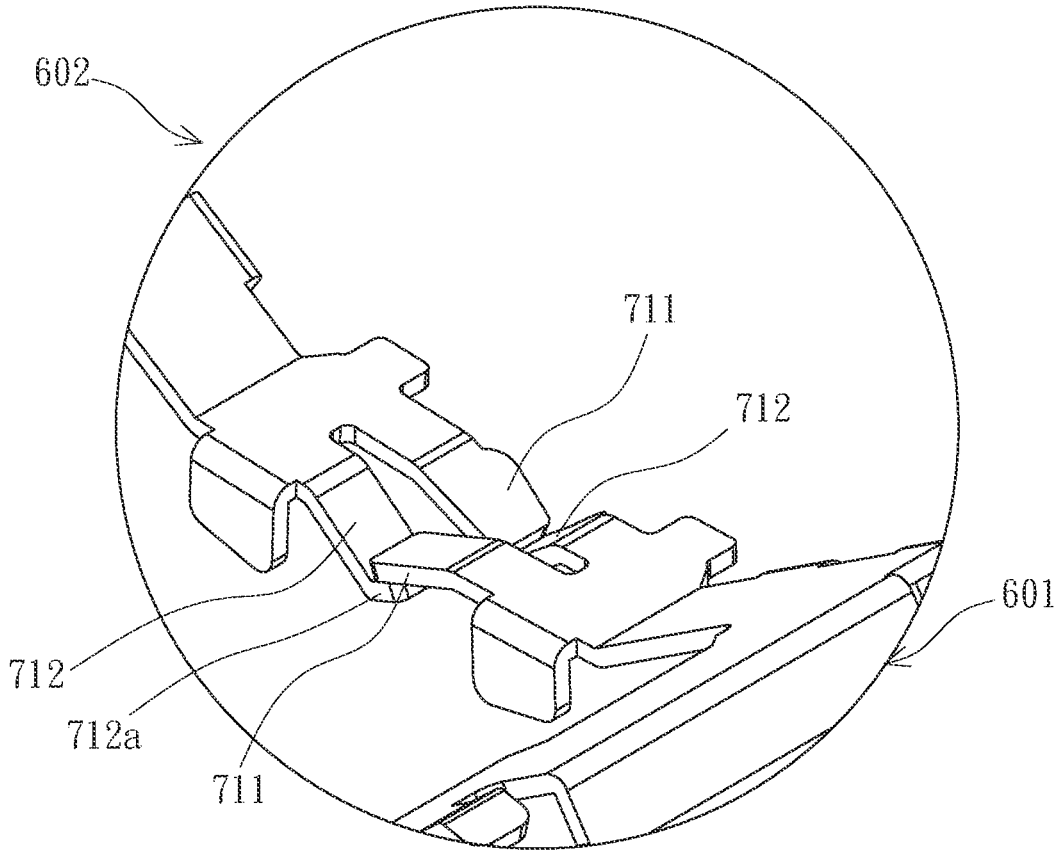
FIG. 19 is a partially enlarged view of the linkage mechanism in the third embodiment of the invention.

Referring to FIG. 18 and FIG. 19, in a third embodiment, the invention discloses a keyswitch assembly, which is provided for explaining a variant embodiment of the linkage mechanism.

As shown in FIG. 18 and FIG. 19, the pressing piece 711 and the receiving piece 712 in the second embodiment are generally slightly bent downward (e.g. bent toward the substrate 648). Moreover, the front end of the receiving piece 712 is provided with a receiving portion 712*a*, which is bent upward (e.g. bent away from the substrate 648), and a bending angle exists between the receiving portion 712*a* and the receiving piece 712. Referring again to FIG. 19, the bending angle of the receiving piece 712 is larger than the bending angle of the pressing piece 711, and the length of the pressing piece 711 is larger than the length of the receiving piece 712. Similar to the first embodiment, the two side arms 611 and 612 of the first frame 601 and the two side arms 621 and 622 of the second frame 602 can all be provided with the pressing pieces 711 and the receiving pieces 712 at the same time, and two sets of the pressing pieces 711 and the receiving pieces 712 are in the same relative position configuration.

When the keyswitch assembly is pressed, the upward movement of the receiving piece 712 of each of the frames 601 and 602 can push the pressing piece 711 of the other of the frames 601 and 602 upward, so as to drive the two frames 601 and 602 to move in a linking manner. When the external force applied to the keycap 604 is released, the two keycap ends 6014 and 6024 approach each other through the pulling force of the resilient member 605, the linking relationship is that the pressing piece 711 presses the corresponding receiving portion 712 downward to balance the pulling force of the resilient member 605 between the first frame 602 and the second frame 602. When the pressing piece 711 enters the corresponding bending angle, the receiving portion 712*a* hinders the movement of the pressing piece 711, so the two keycap ends 6014 and 6024 reach the highest point in this embodiment.

Figure 20:
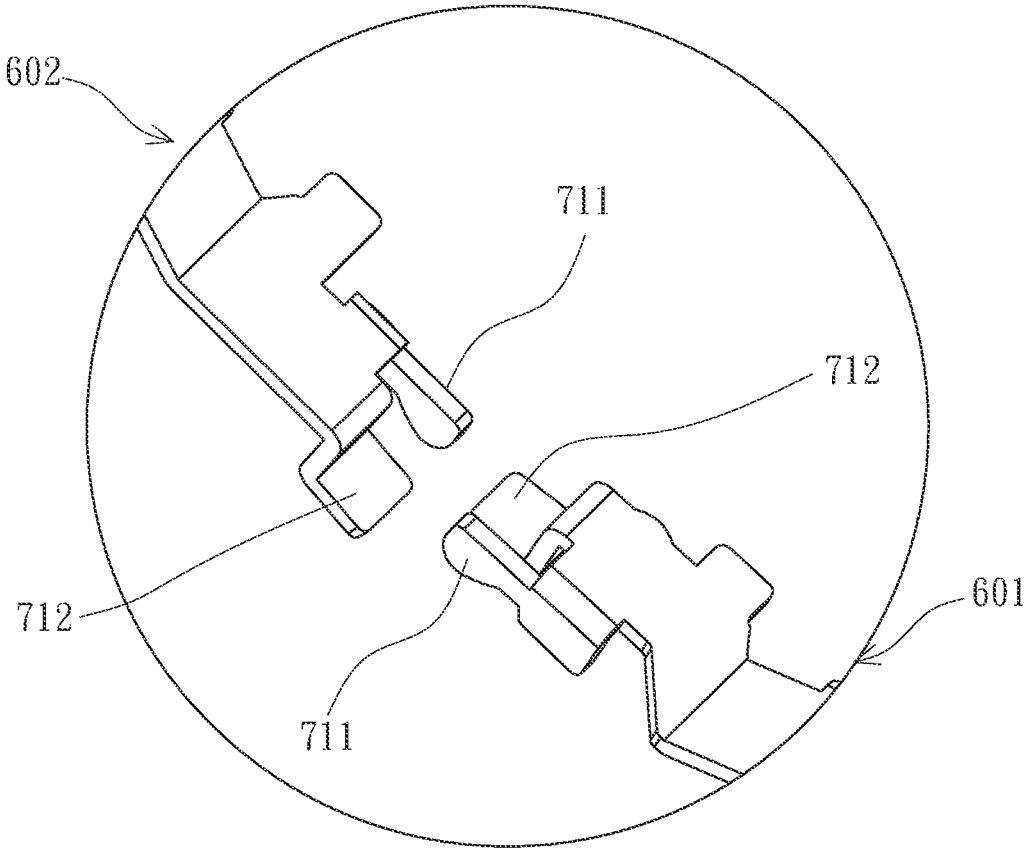
FIG. 20 is a partially enlarged exploded view of the linkage mechanism in a fourth embodiment of the invention.
Figure 21:
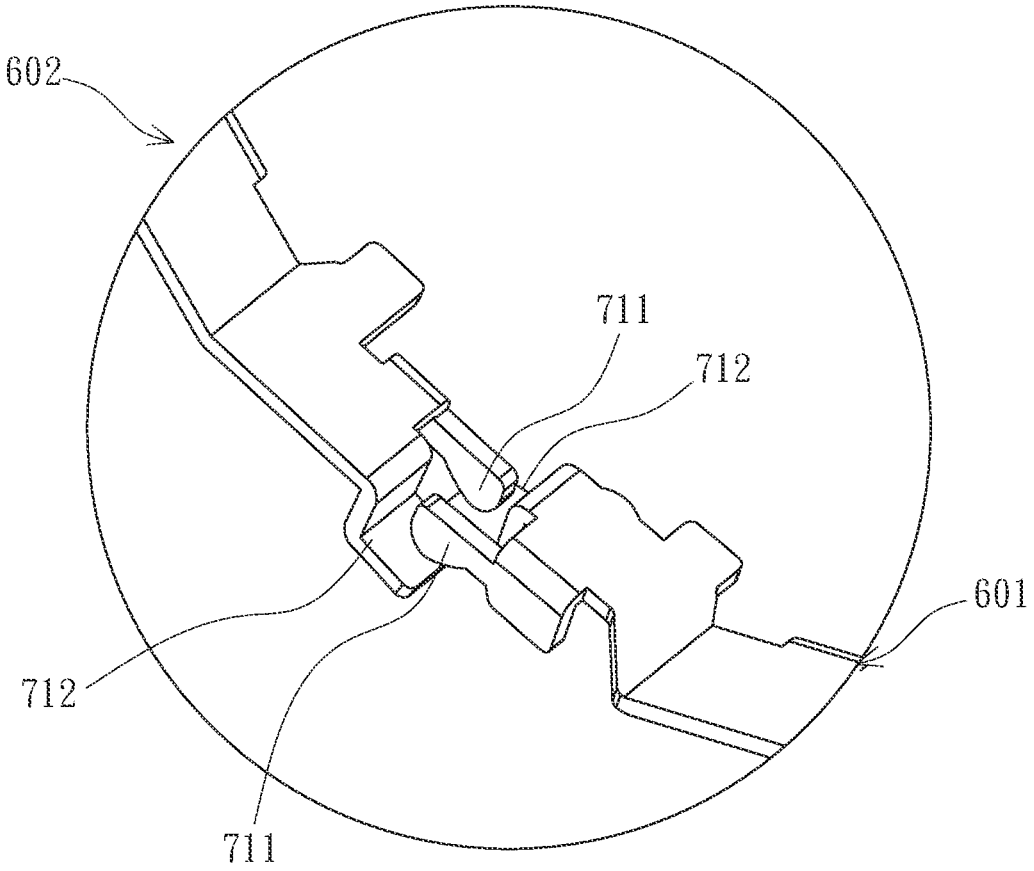
FIG. 21 is a partially enlarged view of the linkage mechanism in the fourth embodiment of the invention.

Referring to FIG. 20 and FIG. 21, in a fourth embodiment, the invention discloses a linkage mechanism, which can be applied to one or more embodiments of the invention.

As shown in FIG. 20 and FIG. 21, the pressing piece 711 is a longitudinal strip vertical to the substrate 648, and the receiving piece 712 is perpendicular to the pressing piece 711. Substantially, the front end of the lower edge of the pressing piece 711 extends downward (e.g. protrudes toward the substrate 648) and has a rounded corner at the junction of the edges. The receiving piece 712 is bent downward (toward the substrate 648) and then bent forward to form the receiving portion 712*a*, which is bent forward. The front end of the lower edge of the pressing portion 711 is configured to contact the receiving portion 712*a*.

With respect to the substrate 648, the pressing piece 711 of each of the first frame 601 and the second frame 602 is positioned over the bent-forward portion of the receiving piece 712 of the other of the first frame 601 and the second frame 602. Similar to the first embodiment, the two side arms 611 and 612 of the first frame 601 and the two side arms 621 and 622 of the second frame 602 can all be provided with the pressing pieces 711 and the receiving pieces 712 at the same time, and two sets of the pressing pieces 711 and the receiving pieces 712 are in the same relative position configuration. In general, the length of the pressing piece 711 is configured in a manner that when the first frame 601 and the second frame 602 are coplanar, the front end of the pressing piece 711 will not contact the bent-downward portion of the receiving piece 712.

When the keyswitch assembly is pressed, the upward movement of the receiving piece 712 of each of the frames 601 and 602 can push the pressing piece 711 of the other of the frame 601 and 602 upward, so as to drive the two frames 601 and 602 to move in a linking manner. When the external force applied to the keycap 604 is released, the linking relationship is that the pressing piece 711 presses the corresponding receiving portion 712 downward to balance the pulling force of the resilient member 605 between the first frame 602 and the second frame 602.

Compared to the prior art, the keyswitch assembly of the invention utilizes the support mechanism to drive the blocking mechanism to change the degree of blocking the sensing signal as a switch signal, so as to achieve fast and accurate conversion of the pressing signal, and can be applied to various kinds of keyswitch structures for portable electronic devices. Moreover, the first frame 601 and the second frame 602 of the support mechanism of the invention are linked with each other through the linkage mechanism, so that the first frame 601, the second frame 602 and the keycap can be certainly linked, and the movement of the blocking mechanism 670 is certainly linked with the movement of the keycap 604, effectively preventing the pressed state of the keycap 604 from not being correctly detected.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A keyswitch assembly, comprising:

a switch module comprising a substrate, a signal generator, and a signal sensor, wherein the signal generator and the signal sensor are disposed on the substrate, the signal generator is configured to provide a sensing signal to the signal sensor, and the signal sensor is configured to receive the sensing signal to correspondingly obtain a sensing intensity;

a support mechanism disposed on a top surface of the substrate, a top portion of the support mechanism moving along an up-down direction in response to a pressing force; and a blocking mechanism comprising:

a pivoting portion rotatably disposed on the top surface;

a connecting piece extending from the pivoting portion, the connecting piece movably connected to the support mechanism to be driven by movement of the top portion, so as to swivel along the up-down direction relative to the substrate; and a blocking piece extending from the pivoting portion, the blocking piece configured to be driven by the connecting piece to be inserted into or escape from a gap between the signal generator and the signal sensor, so as to change a magnitude of the sensing intensity.

2. The keyswitch assembly of claim 1, wherein the signal generator and the signal sensor are a combination of a light emitter and a light receiver, or the signal generator and the signal sensor are a combination of a magnet and a Hall sensor.

3. The keyswitch assembly of claim 1, wherein the signal generator and the signal sensor are arranged along a signal transmission direction, and the signal transmission direction is perpendicular to a rotation axis of the pivoting portion.

4. The keyswitch assembly of claim 1, wherein the blocking piece and the connecting piece are located at a same side or different sides with respect to a rotation axis of the pivoting portion.

5. The keyswitch assembly of claim 1, wherein the support mechanism comprises:

two frames, each of the two frames having a baseplate end and a keycap end, each of the baseplate ends movably connected to the substrate, the two frames extending outward, so that the keycap ends of the two frames are away from each other, and the keycap ends of the two frames constitute the top portion of the support mechanism; and a resilient member connecting the keycap ends of the two frames, wherein the signal generator and the signal sensor are located between projections of the keycap ends of the two frames on the top surface; the connecting piece is movably connected to one of the keycap ends, and a rotation axis of the pivoting portion is parallel to rotation axes of the two frames.

6. The keyswitch assembly of claim 5, wherein one of the keycap ends is formed with a slot, and the connecting piece is slidably inserted into the slot.

7. The keyswitch assembly of claim 5, wherein the connecting piece is a longitudinal strip disposed vertical to the top surface; a distal end of the connecting piece has a notch; one of the keycap ends has a guiding piece configured to be inserted into the notch, and a width of the notch is larger than a thickness of the guiding piece.

8. The keyswitch assembly of claim 1, further comprising a keycap disposed on the top portion of the support mechanism to be positioned over the top surface through support of the support mechanism, wherein the support mechanism supports the keycap to move up-down relative to the substrate.

9. The keyswitch assembly of claim 8, further comprising a backlight source disposed on the top surface and configured to emit light toward the keycap.

10. The keyswitch assembly of claim 9, further comprising a diffusion member combined with the top surface to cover the backlight source.

11. The keyswitch assembly of claim 9, wherein the substrate has a groove and a bottom surface opposite to the top surface; the backlight source is located at one of the top surface and the bottom surface of the substrate, and at least one of the signal generator and the signal sensor is located at the other one of the top surface and the bottom surface of the substrate; a front end of the blocking piece is configured to be inserted into the groove, so as to be inserted into or escape from the gap between the signal generator and the signal sensor.

12. The keyswitch assembly of claim 1, further comprising a shielding member disposed on the top surface, wherein the shielding member has a window; the shielding member surrounds the signal generator and the signal sensor, and the blocking piece extends through the window.

13. The keyswitch assembly of claim 12, wherein the blocking mechanism further comprises two pivoting tabs respectively extending from two sides of the pivoting portion; the two pivoting tabs are configured to rotatably position the pivoting portion on the shielding member along a rotation axis of the pivoting portion.

14. A support mechanism for a keyswitch including a substrate, comprising:

two frames, each of the two frames having a baseplate end and a keycap end, each of the baseplate ends of the two frames movably connected to the substrate, the two frames extending outward, so that the keycap ends of the two frames are away from each other, wherein each of the two frames further has a frame body and a side arm extending from the frame body, each of the frame bodies constitutes the keycap end, and a distal end of each of the side arms constitutes the baseplate end, wherein a front end of each of the side arms of the two frames is provided with a pressing piece and a receiving piece; the pressing piece and the receiving piece extend outward along a longitudinal direction of a corresponding side arm and are arranged side by side along a rotation axis of the two frames; for each of the two frames, the pressing piece of one of the two frames is positioned over the receiving piece of another one of the two frames.

15. The support mechanism of claim 14, wherein an extension portion laterally extends from the pressing piece;

a distal end of the extension portion is bent toward the substrate and extends forward to form the receiving piece.

16. The support mechanism of claim 14, wherein the pressing piece and the receiving piece are bent toward the substrate; a front end of the receiving piece is provided with a receiving portion bent away from the substrate, and a bending angle exists between the receiving portion and the receiving piece.

17. The support mechanism of claim 16, wherein a bending angle of the receiving piece is larger than a bending angle of the pressing piece, and a length of the pressing piece is larger than a length of the receiving piece.

18. The support mechanism of claim 14, wherein the pressing piece is perpendicular to the substrate, and the receiving piece is perpendicular to the pressing piece.

19. The support mechanism of claim 18, wherein a front end of a lower edge of the pressing piece is configured to protrude toward the substrate; the receiving piece is bent toward the substrate and then bent forward to form a receiving portion, and the lower edge of the pressing piece is configured to contact the receiving portion.

* * * * *